US006196738B1

(12) United States Patent
Shimizu et al.

(10) Patent No.: US 6,196,738 B1
(45) Date of Patent: Mar. 6, 2001

(54) KEY TOP ELEMENT, PUSH BUTTON SWITCH ELEMENT AND METHOD FOR MANUFACTURING SAME

(75) Inventors: Takao Shimizu; Satoshi Mieno; Tsutomu Nagasawa; Yoshinari Shizukuda, all of Saitama (JP)

(73) Assignee: Shin-Etsu Polymer Co., Ltd. (JP)

( * ) Notice: Subject to any disclaimer, the term of this patent is extended or adjusted under 35 U.S.C. 154(b) by 0 days.

(21) Appl. No.: 09/362,766

(22) Filed: Jul. 28, 1999

(30) Foreign Application Priority Data

Jul. 31, 1998 (JP) ..... 10-216958
Feb. 12, 1999 (JP) ..... 11-034288

(51) Int. Cl.[7] ..... H01H 9/18
(52) U.S. Cl. ..... 400/490; 200/314; 200/514
(58) Field of Search ..... 400/487, 490, 400/491, 493, 494, 495; 200/314, 514

(56) References Cited

U.S. PATENT DOCUMENTS

| | | | | |
|---|---|---|---|---|
| 4,937,408 | * | 6/1990 | Hattori et al. | 200/314 |
| 5,032,853 | * | 7/1991 | Van Stiphout et al. | 346/157 |
| 5,234,744 | * | 8/1993 | Kenmochi | 200/314 |
| 5,573,107 | * | 11/1996 | Nakano et al. | 200/314 |
| 5,807,002 | * | 9/1998 | Tsai | 400/490 |
| 5,873,454 | * | 2/1999 | Nakamura | 200/514 |
| 5,911,317 | * | 6/1999 | Tsai | 400/490 |

FOREIGN PATENT DOCUMENTS

| | | |
|---|---|---|
| 2149372 | 11/1995 | (CA) . |
| 295 05 969 | 6/1995 | (DE) . |
| 0 593 804 | 4/1994 | (EP) . |
| 11-149841 | 2/1999 | (JP) . |
| 97/38842 | 10/1997 | (WO) . |

OTHER PUBLICATIONS

Patent Abstracts of Japan, Publication No. 11149841, Feb. 6, 1999.

* cited by examiner

*Primary Examiner*—John S. Hilten
*Assistant Examiner*—Leslie J. Grohusky
(74) *Attorney, Agent, or Firm*—Lerner, David, Littenberg, Krumholz & Mentlik, LLP

(57) ABSTRACT

A key top element capable of being manufactured while permitting a design of a display section thereof to be readily modified and corrected, accommodating a variety of data for design formation, and capable of exhibiting increased design properties. The key top element includes a printed sheet constituted by a substrate sheet member, an on-demand printed layer and a white- or silver-colored layer, as well as transparent key top members fixedly bonded to the printed sheet. The on-demand printed layer is printed in the form of a symbol or the like on the substrate sheet member using an on-demand printing machine. A push button switch element is also disclosed which includes such a key top element and a light-permeable rubber cover base bonded to the key top element.

76 Claims, 5 Drawing Sheets

KEY TOP ELEMENT, PUSH BUTTON SWITCH ELEMENT AND METHOD FOR MANUFACTURING SAME

BACKGROUND OF THE INVENTION

This invention relates to a key top element for a switch suitable for use for a mobile communication device such as a portable telephone, a domestic telephone, an electronic pocket notebook, a measuring instrument, a vehicle-mounted switch, a remote controller, a data input unit for a computer or a personal computer, a switch unit or the like and an element for a push button switch (hereinafter referred to as "push button switch element") including such a key top element and a method for manufacturing the same, and more particularly to a key top element suitable for use for not only a display section for displaying a character, a symbol, a figure or the like while exhibiting enhanced design properties, visibility and durability but a back-lighted push button switch and a push button switch element including such a key top element.

In general, in a push button switch for a unit such as a mobile communication device like a portable telephone, an electronic pocket notebook, a measuring instrument, a remote controller or the like, a push button switch element or a cover element including a key top element is received in a casing of the unit while being mounted on a circuit board, to thereby provide a push button switch for operating a circuit on the circuit board. The key top element used for such a push button switch element is made of a plastic material and has a character, a numeral, a symbol or the like printed thereon as required. In recent years, a key top member of the key top element is proposed which is formed of a transparent resin material and has a character, a numeral, a code, a symbol or the like printed on a rear surface thereof in the form of a printed layer, resulting in the printed layer being protected with the key top member and the key top element exhibiting a high-quality feeling. Also, the key top element is often realized in the form of a back-lighted push button switch using an LED or the like.

Such a key top member for a push button switch is formed of a transparent thermoplastic resin material such as polyester, polycarbonate, acrylic resin, styrene or the like or a hardening or thermosetting resin such as silicone, urethane, unsaturated polyester, vinyl ester, acrylic resin by injection molding, compression molding, cast molding, transfer molding or the like. Then, the key top member thus prepared is formed on a rear surface thereof with a symbol by screen printing, pad printing or the like. Also, as required, a plurality of such key top members are adhesively arranged on a cover substrate made of rubber, a conical spring made of polyester or the like and then incorporated in a key board section of a portable telephone or the like.

As described above, in the conventional key top element, printing of a symbol or the like is carried out directly on the rear surface of each of the key top members. Thus, screen printing or pad printing is conventionally employed for this purpose. Unfortunately, screen printing or pad printing requires to prepare a design picture called a block copy depending on a color of a print design and prepare a screen plate or an intaglio using the block copy thus prepared. Also, it requires to use a printing plate of a configuration corresponding to a symbol such as a character, a numeral, a code or the like for every color, so that it is required to carry out the printing by the number of times corresponding to the number of colors to be used. Thus, the prior art renders the printing highly troublesome and causes design properties to be deteriorated, resulting in substantially failing to print a distinct photograph, illustration, picture or the like with increased definition. In addition, the prior art causes the cost for plate making to be increased when diversified small-quantity production takes place and renders a change in design highly troublesome.

Also, the printing is made on the rear surface of each of the transparent key top members, so that an increase in thickness of the key top member causes a printed region on the key top member to be deeply positioned in a unit such as a portable telephone when it is incorporated in the unit. This fails to permit external light to satisfactorily reach the printed region, so that the printed region looks dark and dull when it is observed using reflected light, resulting in being deteriorated in visibility. Such visibility is ensured when the key top member is formed to have a thickness as small as about 1 mm or less. Unfortunately, the prior art fails to provide the key top member of such a small thickness.

SUMMARY OF THE INVENTION

The present invention has been made in view of the foregoing disadvantages of the prior art.

Accordingly, it is an object of the present invention to provide a key top element which is capable of permitting the design of a display section thereof to be carried out using design data obtained by a computer.

It is another object of the present invention to provide a key top element which is capable of being manufactured while permitting the design of a display section thereof to be readily modified and corrected.

It is a further object of the present invention to provide a key top element which is capable of eliminating the cost for form making or plate making and readily accommodating a variety of data for design formation, because the design is obtained by form-free or plate-free printing.

It is still another object of the present invention to provide a key top element which is capable of exhibiting increased design properties which are never obtained by conventional screen printing.

It is yet another object of the present invention to provide a method for manufacturing a key top element which is capable of providing a key top element accomplishing the above-described objects.

It is even another object of the present invention to provide a push button switch element which is capable of permitting the design of a display section thereof to be carried out using design data obtained by a computer.

It is a still further object of the present invention to provide a push button switch element which is capable of being manufactured while permitting the design of a display section thereof to be readily modified and corrected.

It is a yet further object of the present invention to provide a push button switch element which is capable of eliminating the cost for form making or plate making and readily accommodating to a variety of data for design formation, because the design is obtained by form-free or plate-free printing.

It is an even further object of the present invention to provide a push button switch element which is capable of exhibiting increased design properties which are never obtained by conventional screen printing.

It is another object of the present invention to provide a method for manufacturing a push button switch element which is capable of providing a push button switch element accomplishing the above-described objects.

In accordance with one aspect of the present invention, a key top element is provided. The key top element includes a printed sheet formed thereon with at least one printed display section and at least one push button-shaped key top member made of a light-permeable resin material and arranged so as to positionally correspond to the printed display section. The printed sheet includes a substrate sheet member made of a transparent or semitransparent thermoplastic resin material, an on-demand printed layer constituting the printed display section, and a light-blocking or semitransparent colored layer which is white or silver.

In a preferred embodiment of the present invention, a plurality of such key top members and therefore a plurality of such printed display sections are arranged.

In a preferred embodiment of the present invention, the printed sheet and key top member are integrally fixed together through a transparent or semitransparent adhesive.

In a preferred embodiment of the present invention, the on-demand printed layer is arranged on a lower surface of the substrate sheet member and the colored layer is arranged on the on-demand printed layer.

In a preferred embodiment of the present invention, the on-demand printed layer is arranged on an upper surface of the substrate sheet member and the colored layer is arranged on a lower surface of the substrate sheet member.

In a preferred embodiment of the present invention, the on-demand printed layer is formed of fine dots of a plurality of colors, to thereby render the display section light-permeable.

In accordance with another aspect of the present invention, a method for manufacturing a key top element is provided. The method includes the steps of: subjecting a substrate sheet member made of a transparent or semitransparent thermoplastic resin material to color printing using fine dots of a plurality of colors by feeding a printing unit with color design data obtained by computer design techniques, to thereby form an on-demand printed layer including at least one printed display section; forming a colored layer which is white or silver on one surface of the substrate sheet member thus printed, resulting in a printed sheet being provided; and integrally mounting at least one transparent key top member made of a light-permeable resin material on a predetermined portion of the printed sheet by bonding.

In a preferred embodiment of the present invention, the on-demand printed layer is formed by the printing unit using at least one printing technique selected from the group consisting of heat transfer sublimation printing techniques, toner electronic printing techniques, electrostatic image printing techniques, laser exposure heat development transfer printing techniques, ink jet printing techniques and thermal color development printing techniques.

In a preferred embodiment of the present invention, the printed sheet and transparent key top member are integrally fixed on each other by means of a transparent or semitransparent adhesive.

In a preferred embodiment of the present invention, the printed display section is formed substantially by full-color printing using inks of one ink system selected from the group consisting of a CMY (cyan, magenta, yellow) ink system, a CMYK (cyan, magenta, yellow, black) ink system and an RGB (red, green, blue) ink system.

In a preferred embodiment of the present invention, the on-demand printed layer is arranged on a lower surface of the substrate sheet member and the colored layer is arranged on the on-demand printed layer.

In a preferred embodiment of the present invention, the on-demand printed layer is arranged on an upper surface of the substrate sheet member and the colored layer is arranged on a lower surface of the substrate sheet member.

The key top element of the present invention, as described above, includes at least one transparent key top member formed of a transparent thermoplastic resin material or a transparent hardening or thermosetting resin material into a shape like a plate-, column- or dome-like push button, as well as the printed sheet including the printed display sections on which a symbol or the like is printed. The key top element of the present invention is not limited to arrangement of a single key top member. Thus, the key top element of the present invention includes arrangement of a plurality of such key top members in any desired array, for example, a key top sheet, a key top member assembly and the like.

The key top element of the present invention may be urged by means of a spring, a diaphragm or the like or fixed on a rubber sheet, a diaphragm sheet or the like. The key top element cooperates with a circuit board and the like to constitute a push button switch or the like. The circuit board used for the push button switch is mounted thereon with any suitable elements such as movable contacts, fixed contacts, circuit elements known in the art, a light emitting element such as an LED, and the like, as required. The circuit board is then received in a casing of an intended device such as a portable telephone, a key board or the like. The casing is provided with apertures corresponding in number to the key top members of the key top element, so that the key top members are arranged in the casing so as to be outwardly projected through the apertures for operation.

The printed sheet includes the substrate sheet member made of a transparent or semitransparent thermoplastic resin material, the on-demand printed layer, and the light-blocking or semitransparent colored layer which is white or silver, resulting in the printed sheet being constructed to have a three-layer structure.

The substrate sheet member is made of a thermoplastic resin material, as described above. The thermoplastic resin materials include an amorphous thermoplastic resin material, a crystalline thermoplastic resin material, a copolymer thereof, and a mixture thereof. More specifically, the thermoplastic resin materials include polyethylene terephthalate, polyethylene naphthalate, polycarbonate, polypropylene, polyacrylic ester, polystyrene, polyvinyl chloride and the like. The thermoplastic resin material is either colorless or colored and either transparent or semitransparent.

Also, the substrate sheet material is preferably made of polyester or polyimide of 10 to 250 $\mu$m in thickness in view of suitability thereof for printing. The substrate sheet material, as described above, is provided thereon with the on-demand printed layer. In this instance, it is provided with a printing ink receiving layer depending on suitability thereof for printing. More specifically, when heat transfer sublimation type printing is carried out, it may be provided thereon with a coating layer made of vinyl chloride-vinyl acetate resin or polyester resin; whereas when ink jet printing takes place, a water absorption layer for fixing a water-soluble ink may be formed thereon. Also, in order to improve adhesion of the substrate sheet material, it may be subjected to a corona discharge treatment, a plasma treatment, an ultraviolet (UV) treatment, a primer treatment or the like.

Then, the substrate sheet member is subjected to on-demand printing. In the printing, a symbol or the like to be printed is designed on a monitor screen of a computer. Software used for the design is suitably selected depending on a function thereof as desired. For example, paint-type software commercially available under the tradename "PHOTOSHOP" from Adobe Systems Incorporated may be used for printing of a photograph or a fine graphic design. Also, draw-type software commercially available under the tradename "ILLUSTRATOR" from Adobe Systems Incorporated may be used for printing of a symbol or a geometric pattern.

A design made on a computer using such software has novelty which is never obtained by the prior art. For example, in the prior art, a unicolored symbol is printed on the key top member. On the contrary, the present invention using a design made by a computer permits a high-quality landscape or figure photograph or a precise geometric pattern to be printed on the key top member. Also, the present invention permits the number of colors used to be substantially unlimited, so that a symbol or geometric pattern may be not only multi-colored but gradated. This permits a degree of freedom of a design of the key top member to be highly increased.

The design data thus prepared by a computer are then fed to a printing unit, wherein the substrate sheet member is subjected to printing. The printing unit is constructed so as to utilize at least one of heat transfer sublimation printing techniques, toner electronic printing techniques, electrostatic image printing techniques, laser exposure heat development transfer printing techniques, ink jet printing techniques and thermal or heat color development printing techniques. The printing unit is referred to as "on-demand printing unit" herein. The on-demand printing unit substantially carries out full-color printing. The on-demand printing unit is essentially constructed so as to use inks of at least three colors according to a CMY, CMYK or RGB ink system. Printing by the on-demand printing unit is carried out using the color system as fine print dots, resulting in full-color printing being substantially carried out by mixing of the three colors or more. A size of the fine print dots is generally about 0.01 to 0.2 mm in diameter, although it is varied depending on the printing unit. Mixing of the fine print dots or arrangement thereof in proximity to each other permits substantially all colors to be expressed by a principle of the three primary colors and an optical illusion.

Superposition of the light-blocking or semitransparent white- or silver-colored layer on the printed sheet member eliminates a disadvantage that a transparent sheet of thermoplastic resin which is subjected to printing by the on-demand printing unit fails to exhibit sufficient lightness, leading to a deterioration in visibility. Also, the colors of the CMY or RGB ink system fail to permit the on-demand printing unit to carry out printing of a white color, so that lightness and chroma of the printing are insufficient. The above-described arrangement in the present invention eliminates such a deterioration in visibility.

Also, arrangement of the light-blocking or semitransparent white- or silver-colored layer on the printed sheet member also permits external light to be effectively scattered through the light-blocking or semitransparent white- or silver-colored layer, resulting in visibility being highly increased. Further, when a key board includes a back-lighted push button switch having LEDs or the like incorporated therein, it may be semitransparent and colored white. A light cream-like color, a gold color or a copper color may be employed. However, such colors cause a hue of the on-demand printed layer to be substantially varied. Also, a gold color is obtained by mixing a silver color with a light yellow color of the on-demand printed layer, to thereby eliminate use of a commercially available gold color which causes an increase in cost. In addition, a white color and a silver color or the like may be combined with each other, resulting in the colored layer being in a multi-layer form.

Thus, the printed sheet incorporated in the key top element of the present invention includes the substrate sheet member made of a transparent or semitransparent thermoplastic resin material, the on-demand printed layer and the light-blocking or semitransparent white- or silver-colored layer, resulting in being constructed into a three-layer structure. The white- or silver-colored layer is arranged on a rear surface of the on-demand printed layer, as viewed from a top side of the transparent key top member. Thus, the printed sheet may be so constructed that the thermoplastic substrate sheet member, on-demand printed layer and white- or silver-colored layer are downwardly arranged in order or the substrate sheet member, on-demand printed layer and colored layer are downwardly laminatedly arranged in order. However, it is a matter of course that the present invention is not limited to such arrangement of the printed sheet.

The white- or silver-colored layer may be formed by any suitable techniques such as printing, coating, painting, laminating, hot stamping, deposition, sputtering or the like. When the colored layer is formed all over one surface of the substrate sheet member, the colored layer can be made in a continuous manner and at a reduced cost. For example, formation of the colored layer by coating is carried out by coating a white ink on the layer at an increased speed by means of a bar coater or a die coater. Also, formation of the layer by hot stamping may be carried out by stamping a white or silver ink on each of required portions of the layer for a period of time as short as about 1 second. Further, formation of the silver-colored layer by deposition or sputtering permits hologram or high-brightness metallic decoration which is never obtained by the prior art to be effectively provided.

Then, the transparent key top members like a push-button switch which are made of a transparent thermoplastic or hardening resin material are each fixedly mounted on a portion of the thus-prepared printed sheet corresponding to a respective one of the printed display sections by means of an adhesive, to thereby provide the key top element. The transparent key top member may be formed according to any conventional procedure. For example, it may be formed of a thermoplastic resin material such as acrylic resin, polycarbonate, polyester, styrene or the like by means of an injection molding machine, a transfer molding machine or the like. Alternatively, it may be made of a thermosetting or photo-setting resin material such as unsaturated polyester, an acrylic monomer, a styrene monomer, vinyl ester, urethane, epoxy resin, a derivative thereof or the like by an injection molding machine, a cast molding machine or the like. The transparent key top members thus formed are fixedly bonded onto the printed sheet by means of any suitable transparent adhesive such as, for example, an urethane adhesive, an epoxy adhesive, an acrylic adhesive, a polyester adhesive, a silicone adhesive or the like.

In this instance, the key top element may be provided in the form of a sole-type key top element by mounting one such transparent key top member on the printed sheet. Alternatively, it may be provided in the form of a sheet-like key top element by mounting a plurality of such key top members on the printed sheet. The sole-type key top element may be arranged on a rubber sheet, a movable contact, a diaphragm sheet or the like as desired. The sheet-like key top element may be subjected at a part thereof to notch formation, cutout formation, a drawing treatment or the like for the purpose of adjustment of either dimensions thereof or a movable range thereof.

As described above, the key top element of the present invention includes the printed sheet provided with one or more printed display sections such as symbols or the like and one or more transparent key top members like a push button which are made of a transparent thermoplastic or hardening resin material and mounted on the printed sheet so as to positionally correspond to the printed display sections. The printed sheet includes the substrate sheet member made of a transparent or semitransparent thermoplastic resin material, the on-demand printed layer, and the light-blocking or semitransparent white- or silver-colored layer, resulting in the printed sheet being constructed to have a three-layer structure. Such construction of the present invention permits the key top element to accommodate a variety of design formation data, to thereby exhibit high definition and precision and be suitable for diversified small-quantity production. Also, the white- or silver-colored layer compensates for lightness of the on-demand printed layer, so that the printed display section may be increased in lightness and chroma, to thereby exhibit satisfactory visibility. Also, the key top element of the present invention may readily accommodate any specific decoration such as metallic decoration, hologram, a photograph, computer graphics (CG) or the like.

The printed display sections are each covered with the transparent key top member, resulting in wearing of the display section being effectively prevented, so that the key top element may be increased in durability and visibility.

Also, in manufacturing of the key top element of the present invention, a design made by a computer is applied directly to the printed display section, to thereby ensure high quality printing on the printed sheet. In addition, the printing is carried out on the transparent thermoplastic resin sheet, to thereby be reduced in cost. Also, the method of the present invention is effectively accommodated to diversified small-quantity production while reducing the manufacturing cost.

In accordance with a further aspect of the present invention, an element for a push button switch or a push button switch element is provided. The push button switch element includes at least one light-permeable key top member formed of a transparent or semitransparent resin material, a light-permeable rubber cover base and a printed sheet interposedly arranged between the light-permeable key top member and the light-permeable rubber cover base and formed with at least one display section. The printed sheet includes a light-permeable resin sheet member, a graphic printed layer formed on one surface of the light-permeable resin sheet member of fine dots of a plurality of colors so that the display section is light-permeable, and a light-reflecting light-blocking layer arranged on a lower side of the graphic printed layer.

In a preferred embodiment of the present invention, the light-reflecting light-blocking layer has light reflectance of 50% or more.

In a preferred embodiment of the present invention, the push button switch element further includes a semitransparent white layer arranged on a lower surface of the light-reflecting light-blocking layer.

In a preferred embodiment of the present invention, the printed sheet, light-permeable key top member and light-permeable rubber cover base are integrally fixed together by means of transparent or semitransparent adhesives.

In a preferred embodiment of the present invention, the light-reflecting light-blocking layer is formed all over one surface of the printed sheet.

In a preferred embodiment of the present invention, the light-reflecting light-blocking layer is formed with a perforated section of a predetermined shape in a manner to positionally correspond to the light-permeable display section.

In a preferred embodiment of the present invention, the light-permeable resin sheet member is formed on one surface thereof with an ink receiving layer. The graphic printed layer is provided on the ink receiving layer.

In accordance with still another aspect of the present invention, a method for manufacturing a push button switch element is provided. The method includes the steps of: forming a graphic printed layer including at least one light-permeable display section on one surface of a light-permeable resin sheet member using fine dots of a plurality of colors by means of a printer; arranging a light-reflecting light-blocking layer on a lower side of the graphic printed layer to prepare a printed sheet; and bonding at least one light-permeable key top member made of a transparent or semitransparent resin material to an upper surface of the printed sheet and bonding a light-permeable rubber cover base to a lower surface of the printed sheet, resulting in the push button switch element being provided.

In a preferred embodiment of the present invention, the light-reflecting light-blocking layer has light reflectance of 50% or more.

In a preferred embodiment of the present invention, the method further includes the step of arranging a semitransparent white layer on a lower surface of the light-reflecting light-blocking layer to provide the printed sheet.

In a preferred embodiment of the present invention, the printed sheet, light-permeable key top member and light-permeable rubber cover base are integrally fixed together by means of transparent or semitransparent adhesives.

In a preferred embodiment of the present invention, the light-reflecting light-blocking layer is formed by one technique selected from the group consisting of heat transfer of a thin metal film, hot stamping thereof, deposition thereof, ion plating thereof, sputtering thereof, metallic printing of a light-reflecting light-blocking ink, and laminating of light-reflecting light-blocking sheet.

In a preferred embodiment of the present invention, the light-reflecting light-blocking layer is formed all over one surface of the printed sheet.

In a preferred embodiment of the present invention, the light-reflecting light-blocking layer is formed at a portion thereof positionally corresponding to the light-permeable display section with a respective perforated section of a predetermined configuration.

In a preferred embodiment of the present invention, the light-permeable resin sheet member is formed on one surface thereof with an ink receiving layer. The graphic printed layer is provided on the ink receiving layer.

In the push button switch element of the present invention, the key top member may be transparent or semitransparent and made of a thermoplastic resin material such as an acrylic polymer, a polycarbonate polymer, a styrene polymer, a modified polymer thereof or the like by injection molding, transfer molding or the like. Alternatively, the key top member may be made of a thermosetting resin material such as acrylic resin, unsaturated polyester resin, diallyl phthalate resin, styrene resin, urethane resin, silicone resin, a mixture thereof, a modified resin thereof or the like by injection molding, cast molding or the like. The key top member is integrally bonded to the printed sheet by means of a transparent adhesive such as an acrylic adhesive, a polyester adhesive, an urethane adhesive, a thermosetting adhesive, an UV curing adhesive, a solvent-type adhesive or the like.

The resin sheet member for forming the printed layer of the printed sheet is made of a light-permeable resin material such as polycarbonate, polyester, an acrylic polymer or the like and is formed with such an ink receiving layer as required, resulting in being formed with the graphic printed layer including the display sections each constituted by a light-permeable pattern, symbol or the like formed of fine dots of a plurality of colors such as, for example, cyan, magenta and yellow by means of at least one of a heat transfer sublimation type printer, a toner electronic type printer, an electrostatic image type printer, a laser exposure thermal development type printer, an ink jet type printer, a heat transfer type printer and a heating color development type printer.

The light-permeable resin sheet member is made of a thermoplastic resin material. Alternatively, it may be made of an amorphous thermoplastic resin material, a crystalline thermoplastic resin material, a copolymer thereof or a mixture thereof. More specifically, it may be made of polyethylene terephthalate, polyethylene naphthalate, polycarbonate, polypropylene, polyacrylic ester, polystyrene, polyvinyl chloride or the like. This results in the resin sheet member being transparent or semitransparent while being colored.

The resin sheet member is preferably made of polyester, polycarbonate or polyacrylic resin having a thickness of 10 to 500 $\mu$m. The resin sheet member, as described above, is formed with the printed layer. Also, the resin sheet member is provided with the ink receiving layer depending on printing techniques. For example, the ink receiving layer is constituted by a coating layer of either vinyl chloride-vinyl acetate or polyester when heat transfer sublimation printing is employed. When ink jet printing is carried out, it may be formed of a water absorbing layer for fixing a water-soluble ink. Also, a corona discharge treatment, a plasma treatment, an ultraviolet treatment, a primer treatment or the like may be suitably carried out to increase adhesion properties of the resin sheet member as desired.

The graphic display section or sections are formed by color printing in which a colorful light-permeable pattern, symbol, pattern or the like is concurrently formed of fine dots of a plurality of colors such as, for example, cyan, magenta and yellow by means of a heat transfer sublimation type printer, an ink jet type printer, an electrostatic image type printer or the like. Thus, the graphic display sections are formed in a manner unlike lamination during polychrome carried out in the prior art. For example, when the heat transfer sublimation printing takes place, all colors are concurrently printed in dot units as fine as 0.01 to 0.2 mm in diameter on a highly thin ink absorbing layer of the ink receiving layer provided on the rear surface of the transparent resin sheet member. This is true of the other printing techniques such as the ink jet type printing techniques or the like. The printing is made using inks which are reduced in hiding power and concentration. Also, the printing is carried out in dot units. Thus, a symbol, a pattern or the like printed on the printed layer is strictly light-permeable. Also, the printing is carried out in dot units of the three primary colors by means of a printer, to thereby accomplish expression of a half tone, formation of a gradation, a photograph, a graphic design and the like. The three primary colors include cyan, magenta and yellow (CMY). Also, when it is required to emphasize a black tone, black may be added thereto (CMYK). For example, when the three primary colors each express a concentration of 256 gradations, the printing attains full color expression of 16777216 (=$256^3$) colors by three CMY fine dots. Alternatively, the three primary colors may include red, green and blue (RGB).

In formation of the printed layer, color design data obtained according to a computer design procedure are fed to the printer of the heat transfer sublimation type or the like, so that the printer carries out full-color printing on the transparent or semitransparent thermoplastic resin sheet member using fine dots of three or more colors according to the CMY or CMYK ink system. Then, the light-reflecting light-blocking layer formed with the perforated sections having a predetermined configuration corresponding to a symbol or a pattern or having light reflectance of 50% or more is arranged on the lower surface of the resin sheet member by printing, coating, laminating, hot stamping, vapor deposition, sputtering, plating or the like, resulting in the printed sheet being formed. Also, the semitransparent white layer may be further formed on the lower surface of the light-reflecting light-blocking layer by printing, coating, laminating or the like. Then, the above-described key top members and light-permeable rubber cover base are each bonded to the thus-formed printed sheet by means of the transparent adhesive.

The printed layer of the light-permeable resin sheet member exists as the ink receiving layer. Actually, the ink is colored in fine dot units in the ink receiving layer, so that a complicated graphic pattern or photograph as well as a character or symbol may be expressed. The printed layer is arranged in a fine dot-like manner, to thereby permit light to permeate therethrough, resulting in external light being reflected by the light-reflecting light-blocking layer below the printed layer, leading to an increase in visibility and quality of the printed layer. In this instance, when the light-reflecting light-blocking layer is provided in the form of a metal film by deposition, sputtering or the like, the printed layer exhibit a metallic feeling while being rendered distinct, leading to a further increase in quality thereof.

In addition, when the light-reflecting light-blocking layer is formed with the perforated sections of a configuration like a character, a symbol, a pattern or the like, external light is caused to permeate therethrough without being reflected, resulting in visibility being somewhat deteriorated. In order to avoid the disadvantage, the semitransparent white layer is arranged on the lower surface of the light-reflecting light-blocking layer, to thereby prevent a deterioration in visibility and rather increase the visibility.

The printed sheet is constructed into a three-layer structure including the transparent thermoplastic resin sheet member, the printed layer and the light-reflecting light-blocking layer formed with the perforated sections of a configuration like a character or the like.

Also, the printed sheet may be formed to have a size substantially equal to that of the lower surface of the key top member. Alternatively, it may be formed to have a size somewhat larger than the lower surface of the key top member, to thereby provide a flange. Such arrangement effectively prevents dislocation of the key top member when the push button switch element is incorporated in a casing of an electronic unit. Also, it prevents leakage of light when back-lighting of a character or character back-lighting is carried out.

When the light-reflecting light-blocking layer is arranged all over the printed sheet, it fully blocks external light while reflecting it, so that visibility is highly increased. Whereas, when the light-reflecting light-blocking layer is formed with the perforated sections of a configuration like a predetermined character, symbol, pattern or the like, external light is satisfactorily observed and light emitted from a light source arranged below the layer is permitted to permeate through the perforated sections, resulting in satisfactory character back-lighting being attained. The character back-lighting is further enhanced by reflection of external light on the semitransparent white layer.

From a point of view of a design, when the light-reflecting light-blocking layer is made of a silver foil or a silver-colored ink, the layer provides a design of a metallic tone which permits the whole push button switch element to be brightened in a silver color. When the colored layer has a portion corresponding to the silver-colored portion of the light-reflecting light-blocking layer colored red, gray or yellow, a design of a red-metallic, gray-metallic or gold color may be obtained. Also, when the colored layer is provided with a seven-color gradation, a rainbow-like design may be obtained. The light-reflecting light-blocking layer is not limited to a silver color. It may have a white color, a fluorescent color or a pearl gray color which is increased in luminance.

The light-reflecting light-blocking layer arranged on the printed layer may be made by subjecting metal such as aluminum, chromium, gold, silver, copper or the like to heat transfer, hot stamping, plating, vapor deposition, sputtering or the like to form a thin film having the perforated sections of a configuration like a predetermined character, symbol, pattern or the like. Alternatively, it may be made by subjecting a light-reflecting light-blocking ink to screen printing, transfer printing or the like. The light-reflecting light-blocking ink used herein means that having a metal pigment, a white pigment, a fluorescent dye, a pearl pigment, a mica powder or the like filled therein at increased density, to thereby substantially reflect and block light.

Use of the thin metal film or metallic printing provides a specific light-reflecting design having a metallic tone.

Also, when it is desired to obtain either only visibility of increased luminance due to reflection of external light on the light-reflecting light-blocking layer without using any character back-lighting function or only a metallic design, a thin metal film or a light-reflecting light-blocking sheet may be laminated all over the printed layer without being formed with any perforated sections.

For example, an aluminum deposition film or a light-reflecting light-blocking ink may be subjected to heat transfer by means of a printer for this purpose as in printing of the printed layer. In this instance, any desired printing pattern may be obtained by a computer, so that formation of the pattern may be facilitated while reducing a cost thereof.

Formation of a design on a computer while using software permits the design to be novel. For example, it not only permits formation of a landscape or figure photograph at a high picture quality to be attained, but provides a high-precision geometric pattern. Also, it does not cause the number of colors to be subject to any limitation, so that a symbol, a geometric pattern or the like may be provided with a gradation in which a color is gradually varied. This contributes to an increase in degree of freedom of the design.

The light-reflecting light-blocking layer incorporated in the printed sheet is constructed so as to exhibit light reflectance of 50% or more. More particularly, the graphic printed layer including the display section constituted of a light-permeable pattern, symbol or the like formed by fine dots of a plurality of colors using a printer are colored so as to facilitate permeation of light therethrough and reduced in reflectance of external light. Thus, when the light-reflecting light-blocking layer is arranged on the rear surface of the key top members of the push button switch element while being received in an outer casing of an electronic unit, the push button switch element is deteriorated in visibility because external light is reduced to a degree sufficient to disadvantageously reduce lightness. In particularly, when light reflectance of the light-reflecting light-blocking layer is 45% or less, the printed sheet fails to exhibit sufficient distinctness, to thereby be substantially hard to observe or read. Thus, in the present invention, the layer is constructed so as to exhibit light reflectance of 50% or more. This results in external light permeating through the transparent key top members and printed layer and then being reflected by the light-reflecting light-blocking layer, so that the reflected light may be observed. This permits the printed layer to be increased in luminance and lightness, to thereby be increased in visibility. Thus, the printed layer may exhibit increased visibility with a small amount of external light even when the push button switch element is incorporated in an outer casing of an electronic unit.

The semitransparent white layer may be arranged on the lower surface of the light-reflecting light-blocking layer of the printed sheet. When the light-reflecting light-blocking layer is formed with the perforated sections, the perforated sections permit light emitted from a light source arranged below the layer to permeate therethrough, to thereby provide satisfactory character back-lighting. However, when the light source is turned off, the printed layer is deteriorated in visibility for the above-described reason. The semitransparent white layer effectively prevents such a deterioration in visibility.

The semitransparent white layer permits light upwardly directed from below the layer to permeate therethrough due to semitransparency thereof and permits lightness of the perforated sections to be increased to improve visibility due to a white color thereof. The semitransparent white layer may be made of a semitransparent white sheet of resin such as polyester, polypropylene, polyethylene, acrylic resin, polycarbonate or the like. Alternatively, it may be formed of a semitransparent printing ink colored white. The semitransparent white layer may be preferably formed to have a thickness of about 0.01 to 1 mm in view of semitransparency. It may be made by laminating of the resin sheet or by printing, coating or painting of the printed ink.

Thus, the printed sheet may be constructed into either a three-layer structure including the light-permeable resin sheet member, printed layer and light-reflecting light-blocking layer or a four-layer structure including the light-permeable resin sheet member, printed layer, light-reflecting light-blocking layer and semitransparent white layer. Arrangement of the layers is carried out in such a manner that the light-reflecting layer is arranged below the printed layer as viewed downwardly from a top side of the key top members.

Thus, the printed sheet may be constructed so as to arrange the light-permeable resin sheet member, printed layer, light-reflecting light-blocking layer and semitransparent white layer in order from above or arrange the printed layer, light-permeable resin sheet member, light-reflecting light-blocking layer and semitransparent white layer in order from above. The arrangement may be selected as desired in view of the convenience of manufacturing of the push button switch element.

The semitransparent white layer may be made of an ink by printing, coating, painting, laminating, hot stamping or the like. When it is formed all over one surface of the resin sheet member, the formation may be carried out in a continuous manner and at a reduced cost. For example, coating of a white ink may take place at an increased speed by means of a bar coater or a die coater. The hot stamping may be carried out on a required portion of the resin sheet member for a period of time as short as about 1 second.

Now, a structure of the printed sheet and a design thereof will be described more detailedly. It is supposed that a portion of the printed layer is colored blue so as to correspond to the whole key top member and formed at a part thereof with a brown character. Also, supposing that the light-reflecting light-blocking layer constituted of an aluminum deposition film of 85% in light reflectance and having the perforated section formed at a portion thereof corresponding to the brown character is arranged on the rear surface of the printed layer and the semitransparent white layer or resin sheet is laminatedly arranged on the rear surface of the light-reflecting light-blocking layer, the blue colored part of the printed layer corresponding to the key top member may be observed to be a blue-metallic color which is readily visualized with a small amount of external light due to light reflection on the aluminum deposition film. Also, the brown character may be readily observed due to scattering of light on the semitransparent white layer. Further, only the brown character is irradiated with light upwardly directed through the semitransparent white layer from below the layer, so that satisfactory character backlighting may be attained to increase visibility.

The aluminum deposition film for the light-reflecting light-blocking layer may be subjected to hologram decoration, to thereby provide a three-dimensionally raised design or a fine metal pattern like hairlines. Also, when the printed layer is yellow rather than blue, it provides a gold color in cooperation with the aluminum deposition film inherently exhibiting a silver color. The printed sheet thus constructed so as to exhibit increased light reflectance is bonded to the transparent key top members, to thereby provide the push button switch element with enhanced visibility. Thus, when the push button switch element incorporated in an electronic unit such as a portable telephone, audio equipment or the like, it emits a large amount of reflected light, to thereby exhibit increased visibility even in a poorly lighted environment such as a poorly lighted room, the evening, the shade out of doors or the like.

Moreover, the light-reflecting light-blocking layer is not required to be formed to have a configuration identical with a printed symbol of the printed layer. For example, when the light-reflecting light-blocking layer is formed with the perforated sections of a configuration different from the symbol, observation of the perforated pattern by reflected light is prevented and only the observation by light permeating through the pattern is permitted. This permits a design of a so-called transparency character to be provided.

The key top members are fixedly bonded to the printed display sections of the thus-provided printed sheet by means of any suitable adhesive such as an urethane adhesive, an epoxy adhesive, an acrylic adhesive, a polyester adhesive, a silicone adhesive or the like. Then, the rubber cover base is bonded to the printed sheet, resulting in the push button switch element being provided.

BRIEF DESCRIPTION OF THE DRAWINGS

These and other objects and many of the attendant advantages of the present invention will be readily appreciated as the same become better understood by reference to the following detailed description when considered in connection with the accompanying drawings in which like reference numerals designate like or corresponding parts throughout, wherein.

DETAILED DESCRIPTION OF THE PREFERRED EMBODIMENTS

Now, the present invention will be described hereinafter with reference to the accompanying drawings.

Figure 1:
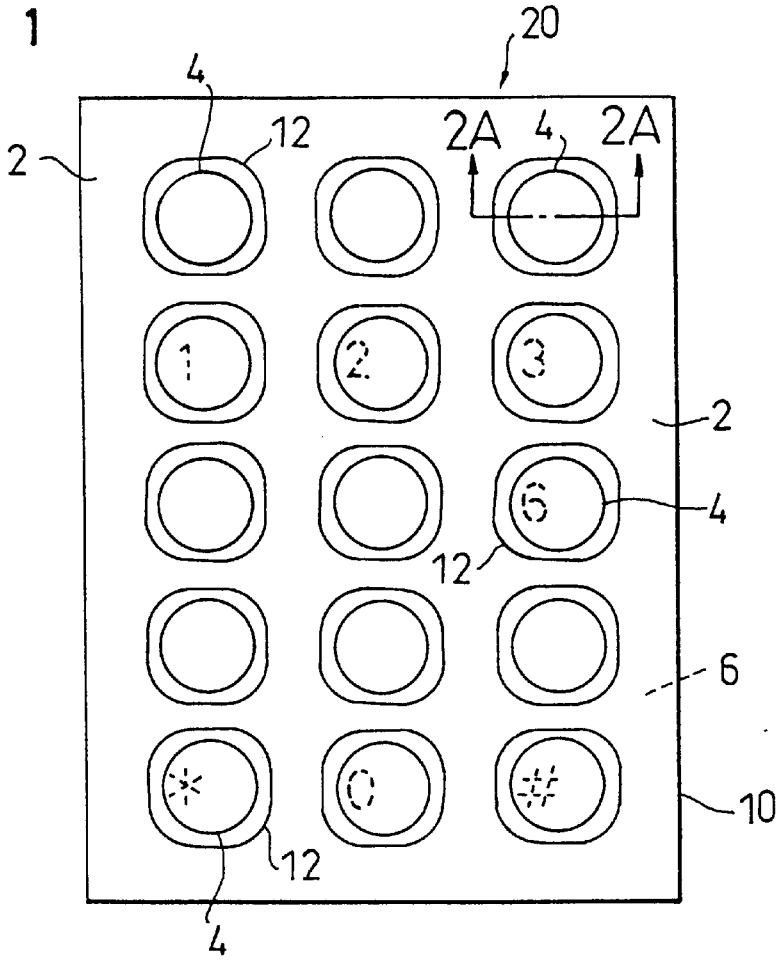
FIG. 1 is a plan view showing an embodiment of a key top element according to the present invention.
Figure 2A:
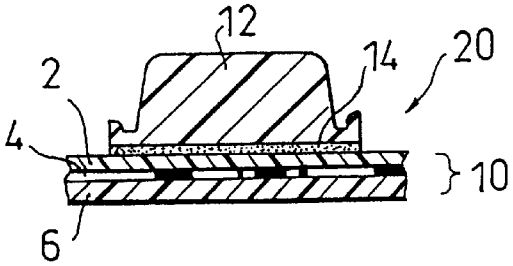
FIG. 2A is an enlarged sectional view taken along line 2A—2A of FIG. 1.
Figure 2B:
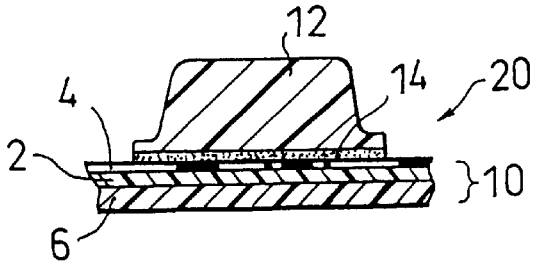
FIG. 2B is a view similar to FIG. 2A showing a modification of the key top element of FIG. 1.

Referring first to FIGS. 1 and 2A, an embodiment of a key top element according to the present invention is illustrated. A key top element of the illustrated embodiment which is generally designated at reference numeral 20 generally includes a printed sheet 10 and one or more key top members 12. In the illustrated embodiment, a plurality of such key top members 12 are arranged. The key top members 12 are each made of a transparent resin material and integrally fixed on the printed sheet 10 through a transparent adhesive 14. The printed sheet 10, as shown in FIG. 2A, includes a substrate sheet member 2 made of a thermoplastic resin material, an on-demand printed layer 4 and a colored layer 6 which is white or silver. The transparent key top members 12 are fixedly mounted on the thus-formed printed sheet 10 by means of the transparent adhesive 14. As shown in FIG. 2A, the printed sheet 10 has the substrate sheet member 2, on-demand printed layer 4 and colored layer 6 laminatedly arranged on each other in order in a downward direction. Alternatively, as shown in FIG. 2B, the on-demand printed layer 4, substrate sheet member 2 and colored layer 6 are downwardly arranged on each other in order.

The on-demand printed layer 4 may have a symbol, a photograph, a geometric pattern or the like printed thereon in a full color depending on design data. When it is desired to illuminate only a character by back lighting, the on-demand printed layer 4 may be designed with a color exhibiting increased light blocking properties, resulting in a configuration of a punched or perforated character being provided.

The printed sheet 10 may be fixedly mounted on a portion of a rear surface thereof corresponding to each of the key top members 12 with either a click plate presser or a reinforcing film as required.

The key top element 20 is received in a casing of an electronic unit such as a portable telephone while being mounted on a circuit board through the click plate or the like, wherein the key top members 12 are each so arranged that a distal end thereof is projected outwardly of the casing in a manner to be pressedly operable, so that pressing operation forces a dome portion of the click plate to bring a movable contact of the dome portion into contact with a fixed contact of the circuit board, resulting in operating a circuit on the circuit board. Also, the key top element 20 may be separated or divided for every key top member 12, followed by mounting of the separated or discrete key top members on the circuit board. Alternatively, the key top element 20 may be received in a sheet-like manner in the casing.

Figure 3:
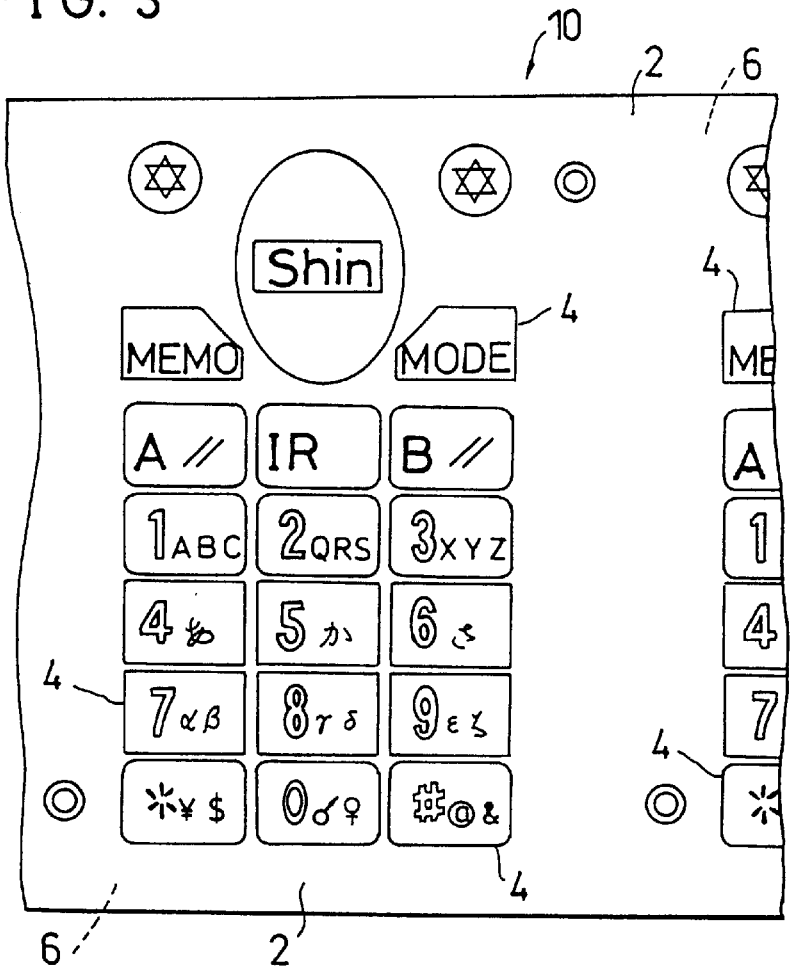
FIG. 3 is a fragmentary plan view showing a modification of a printed sheet.

FIG. 3 shows an on-demand printed design of the printed sheet 10 by way of example. The printed sheet 10 has symbols or the like which correspond to functions of the key top members printed thereon. The design applied to the printed sheet 10 is shown in FIG. 3 in a manner to be highly simplified for the sake of brevity. Actually, any complicated design such as a photograph, a high-precision geometric pattern, computer graphics or the like may be applied to the printed sheet 10 as desired. Also, when it is desired to construct the printed sheet 10 into a back-lighted character design, the characters are each punched or perforated and an outer periphery of the character is dark-colored. Then, the semitransparent white- or silver-colored layer 6 is arranged on a rear surface of the printed layer 4. In addition, it is desired that the printed sheet 10 is expressed with a golden color, the on-demand printed layer 4 is colored to be light yellow and the silver-colored layer 6 is arranged on the rear surface of the on-demand printed layer 4. This results in the printed sheet 10 being substantially golden-colored. Likewise, the printed sheet 10 may be colored to be blue-metallic, red-metallic or the like.

Now, manufacturing of the key top element of the illustrated embodiment thus constructed will be described hereinafter.

First, the substrate sheet member 2 which is made of a thermoplastic resin material is subjected to a surface treatment for on-demand printing, if required. More specifically, the substrate sheet member 2 is subjected to, for example, a plasma treatment, a primer treatment or the like and then coated thereon with an ink receiving layer, an ink absorption layer, an ink adhesion layer or the like by means of a coater, resulting in having an ink in an on-demand printing unit applied thereto. Then, the substrate sheet member 2 is subjected to printing of the on-demand printed layer 4, to thereby print predetermined symbols or the like used for a key board on the on-demand printed layer 4 by means of an on-demand printing machine. Also, the white- or silver-colored layer 6 is deposited on the on-demand printed layer 4, resulting in the printed sheet 10 being formed. Then, the printed sheet 10 is fixedly mounted thereon with the transparent key top members 12 through the transparent adhesive 14, to thereby provide the key top element 20. When the colored layer 6 is desired to be colored white, it may be formed by any suitable techniques such as, for example, printing, hot stamping, coating or the like. Alternatively, it may be formed by preparing a white sheet material and then laminating the white sheet material on the on-demand printed layer 4. When the colored layer 6 is desired to be silver-colored, it may be formed by printing or coating a silver-colored ink on the on-demand printed layer 4. Alternatively, it may be formed by subjecting the on-demand printed layer 4 to deposition, sputtering or the like. Also, it may be formed by hot stamping.

The transparent key top members 12 may be manufactured by injection molding, cast molding or the like of any suitable material such as acrylic resin, polycarbonate resin, polyester resin or the like. In this instance, in view of bonding of the printed sheet 10 to the transparent key top members 12, the transparent key top members 12 are each desirably formed so that a rear surface thereof on which the printed sheet 10 is bonded has a shape as flat as possible.

Thus, the transparent key top members 12 thus provided are each fixedly mounted on a predetermined position of the printed sheet 10 by means of the transparent adhesive 14, to thereby provide the key top element 20.

The key top element 20 of the illustrated embodiment thus provided is mounted on a circuit board to constitute a switch. More specifically, the key top element 20 is received in a casing of an electronic unit such as a portable telephone or the like while being mounted on the circuit board, to thereby provide a push-button switch used for inputting of a telephone number or the like.

As can be seen from the foregoing, the illustrated embodiment readily realizes printing of a colorful design, substantially improves visibility due to arrangement of the white- or silver-colored layer, significantly increases chroma and lightness, and permits the key top element to be simplified in structure. Thus, the illustrated embodiment permits the key top element to be reduced in manufacturing cost while being provided with a design full of variety. This is also true of the key top element of the back-lighted type, to thereby keep a manufacturing cost thereof from being increased even when diversified small-quantity production thereof takes place. Thus, the key top element of the illustrated embodiment permits the printed sheet acting as a display section to be integrated with rear surfaces of the transparent key top members, to thereby exhibit satisfactory visibility and ensure increased durability while preventing wearing of the display section.

As described above, the illustrated embodiment is constructed so as to design the display sections of the key top element using design data obtained by a computer. This permits the design to be readily changed and corrected. Also, the design is obtained by form-free or plate-free printing, to thereby eliminate a cost for manufacturing the form or plate and readily accommodate a variety of data for design formation. Thus, the key top element of the illustrated embodiment exhibits increased design properties which are never obtained by conventional screen printing and is substantially increased in visibility due to white- or silver-colored layer. Further, the key top element of the illustrated embodiment is increased in lightness and chroma and provides a photograph, an illustration, a picture or the like with increased definition and quality. In addition, the illustrated embodiment unlimitedly increases the number of colors to be displayed and reduces a manufacturing cost of the key top element exhibiting increased design properties. Furthermore, the illustrated embodiment increases the degree of freedom of design, to thereby provide the key top element with a novel design and prevents an increase in manufacturing cost of the key top element even when diversified small-quantity production of the key top element takes place. Also, the key top element of the illustrated embodiment permits the printed display sections to exhibit increased visibility without preventing wearing of the display sections, resulting in exhibiting enhanced durability, because the printed display sections are each integrally mounted on a rear surface of a respective one of the key top members.

In addition, manufacturing of the key top element of the illustrated embodiment is carried out using design data obtained by a computer for a design of the display sections of the key top element, so that a novel design which is never provided by the conventional screen printing may be directly realized in the printed display sections of the key top element, resulting in the printing at high quality being provided. Also, the printing takes place on the sheet made of a transparent thermoplastic resin material, leading to mass production of the key top element and a reduction in cost thereof as compared with printing on a formed article. Moreover, the manufacturing contributes to a substantial reduction in manufacturing cost even when diversified small-quantity production is carried out.

Figure 4:
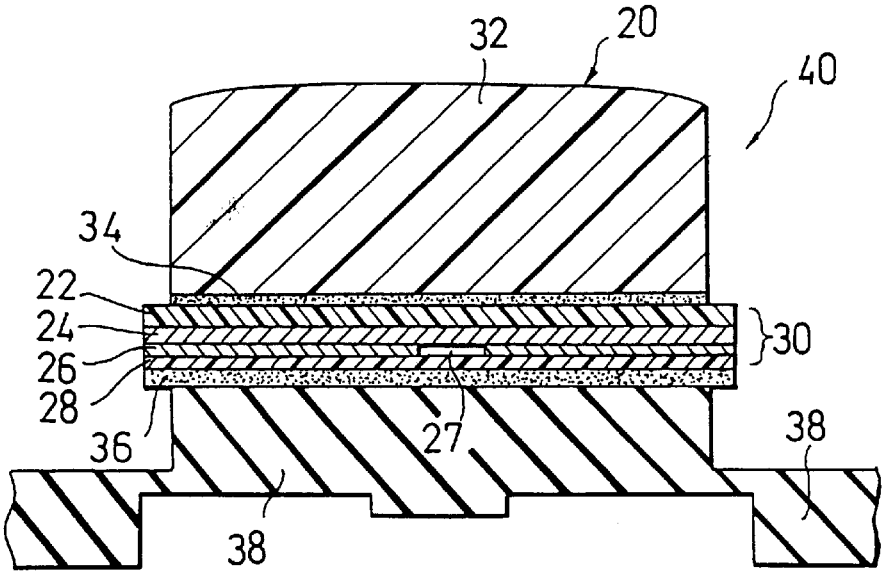
FIG. 4 is a fragmentary enlarged vertical sectional view showing an embodiment of a push button switch element according to the present invention.
Figure 5A:
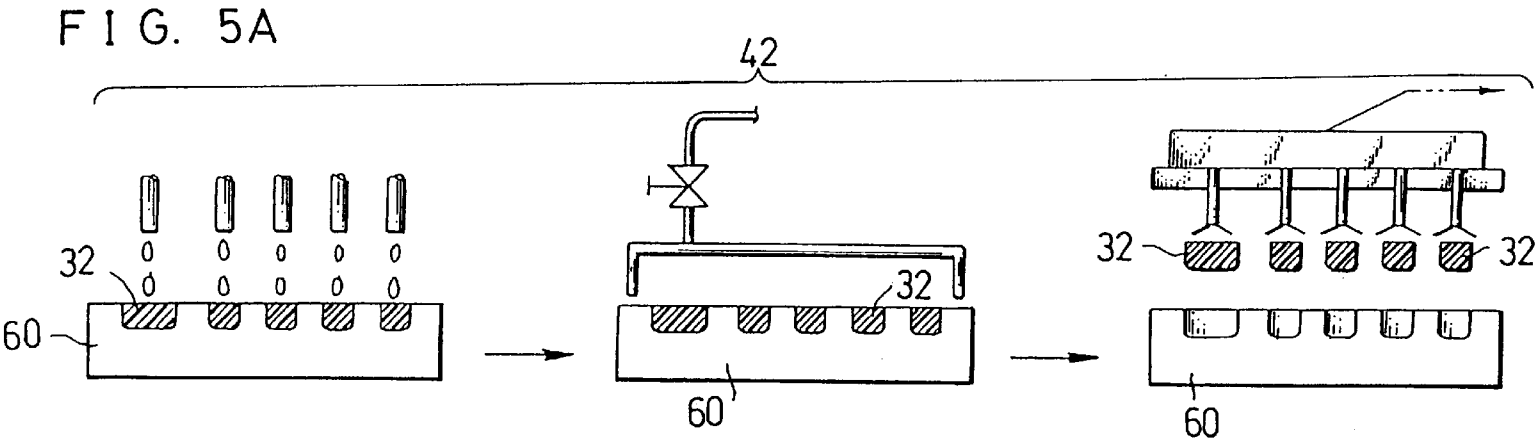
FIG. 5A is a flow diagram showing a key top member formation step in manufacturing of a push button switch element of the present invention.
Figure 5B:
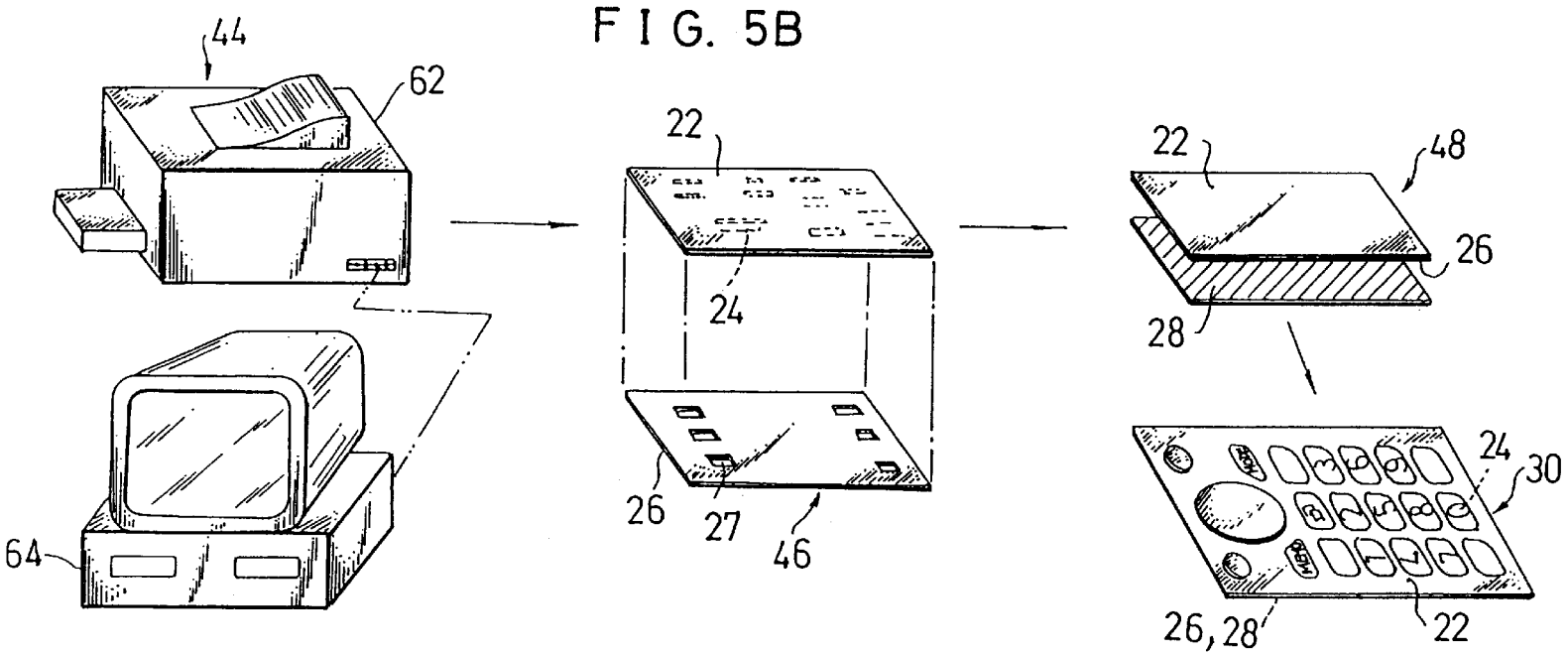
FIG. 5B is a flow diagram showing a printed sheet formation step in manufacturing of the push button switch element of the present invention.
Figure 5C:
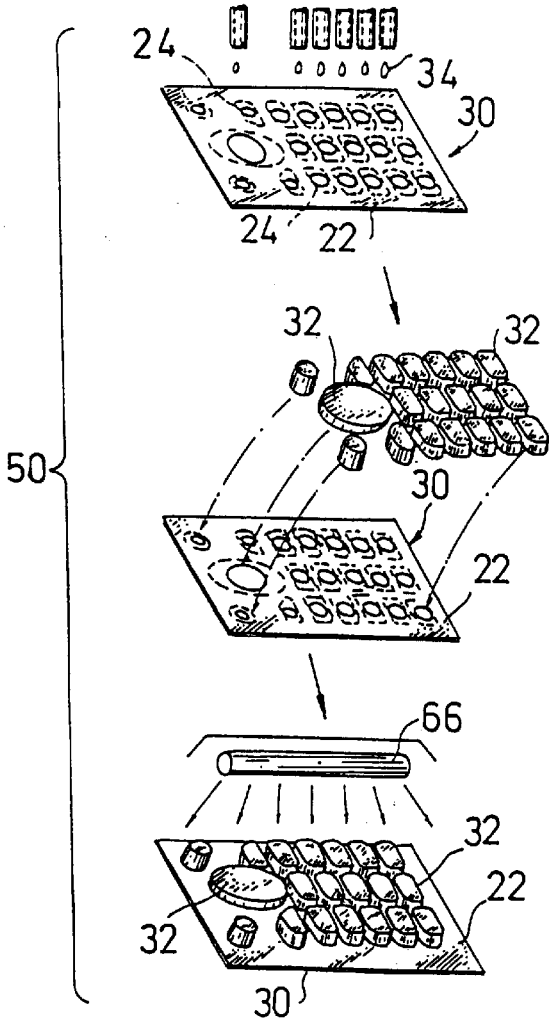
FIGS. 5C to 5F are each a schematic view generally showing the steps in manufacturing of the push button switch element of the present invention in order.

Referring now to FIG. 4, an embodiment of a push button switch element according to the present invention is illustrated. A push button switch element of the illustrated embodiment which is generally designated at reference numeral 40 generally includes a key top element 20 and a light-permeable cover base 38 made of a light-permeable rubber material. The key top element 20 includes one or more light-permeable key top members 32 and a printed sheet 30 arranged between the key top members 32 and the light-permeable rubber cover base 38. In the illustrated embodiment, a plurality of such key top members 32 are arranged. The printed sheet 30 includes a substrate sheet member or resin sheet member 22 made of a transparent resin material and having an upper surface bonded to the key top members 32 by means of a transparent or semitransparent adhesive 34, a printed layer 24 formed with one or more display sections and laminatedly mounted on a lower surface of the resin sheet member 22, and a light-reflecting light-blocking layer 26 exhibiting both light-reflecting and light-blocking properties and formed with punched or perforated sections 27 of a predetermined configuration. The key top members 32, as shown in FIGS. 5A to 5F, are each formed of a transparent or semitransparent thermoplastic or thermosetting resin material by means of a mold 60 in a key top member forming step 42. The transparent resin sheet 22 is formed on one surface thereof with an ink receiving layer as required, which has one or more display sections printed thereon by means of a printer 62 including original design input equipment 64 in a printed layer formation step 44, to thereby form the printed layer 24. The display sections are each constituted by a symbol, a pattern, a color or the like and printed using fine dots having a plurality of colors. The light-reflecting light-blocking layer 26 which is formed with the perforated sections 27 in a manner to correspond to a configuration of the symbols or patterns printed on the printed layer 24 is arranged on a lower surface of the printed layer 24 in a light-reflecting light-blocking layer formation step 46. Then, a semitransparent white layer 28 is formed on a lower surface of the light-reflecting light-blocking layer 26 in a semitransparent layer formation step 48, resulting in the printed sheet 30 being provided. Then, a key top member adhesion step 50 is carried out. More specifically, the printed sheet 30 is coated on an upper surface thereof with the adhesive 34 by means of a high-precision dispenser and then the key top members 32 are positioned on the one surface of the printed sheet 30, followed by irradiation of ultraviolet rays using a UV irradiation means 66. Thereafter, a rubber cover base adhesion step 52 takes place. More particularly, the light-permeable rubber cover base 38 is adhered to a lower surface of the printed sheet 30 by means of a transparent or semitransparent adhesive 36, resulting in the push button switch element 40 being manufactured as shown in FIG. 5F.

The printed sheet 30 shown in FIG. 4 is so constructed that the transparent resin sheet member 22, printed layer 24, light-reflecting light-blocking layer 26, and semitransparent white layer 28 are downwardly arranged in order. Alternatively, it may be constructed in such a manner that the printed layer 24, resin sheet member 22, light-reflecting light-blocking layer 26 and semitransparent white layer 28 are downwardly arranged in order.

In either case, the printed layer 24 has symbols, photographs, geometric patterns or the like printed thereon in a full color. In order to increase visibility of the printed layer 24, the light-reflecting light-blocking layer 26 is arranged under the printed layer 24. When it is desired to back-light only a character, the light-reflecting light-blocking layer 26 may be formed to have a shape like a punched or perforated character.

The light-reflecting light-blocking layer formation step 46 is carried out by subjecting a thin metal film of 50% or more in light reflectance to laminating, heat transfer, hot stamping, deposition, ion plating or sputtering or subjecting a light-reflecting ink of 50% or more in light reflectance to metallic printing, painting or coating while forming the perforated sections of a predetermined configuration such as a symbol, pattern or the like, resulting in the light-reflecting light-blocking layer 26 being provided. Also, the semitransparent white layer 28 may be superposedly arranged on the light-reflecting light-blocking layer 26 thus formed.

Figure 5D:
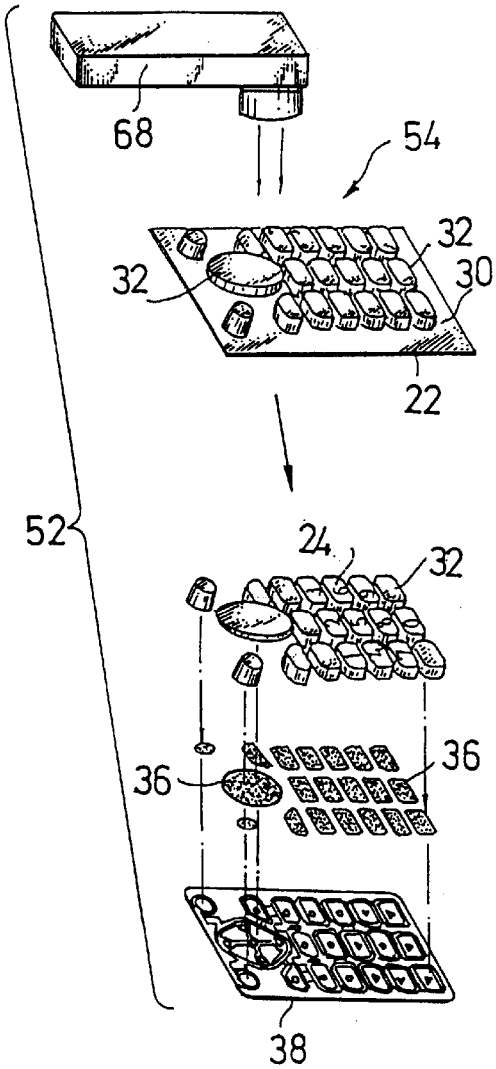
Figure 5E:
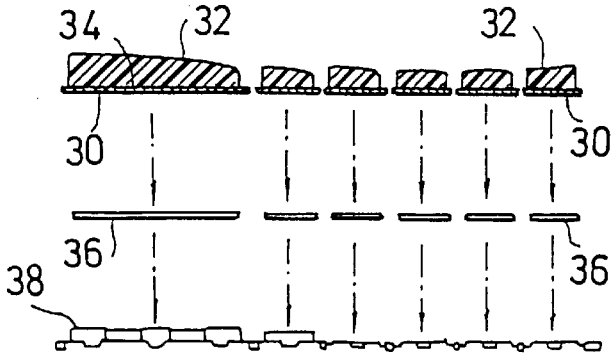
Figure 5F:
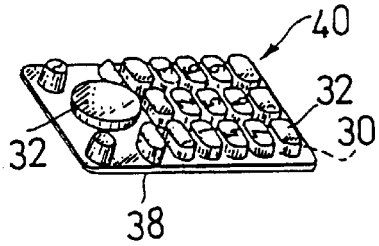

The rubber cover base adhesion step 52, as shown in FIG. 5D, includes a key top member cutting step 54 of cutting each of the key top members 32 bonded to the printed sheet 30 by means of a carbon dioxide laser 68 and a step of bonding the thus-cut individual key top members 32 to the rubber cover base 38 made of a light-permeable silicone rubber material by means of the transparent or semitransparent adhesive 36 on a transparent or semitransparent pressure sensitive adhesive double coated tape. The key top member cutting step 54 is not limited to use of the carbon dioxide gas laser. It may be carried out by punching using a punching blade. Alternatively, the printed sheet 30 is previously cut for every key top member 32 prior to bonding of the key top members 32 thereto.

The key top member formation step 42 shown in FIG. 5A is carried out by cast molding of thermosetting resin. However, when a thermoplastic resin material is used, injection molding takes place.

The rubber cover base 38 may have a reinforcing film fixed on a rear side thereof positionally corresponding to each of the transparent key top members 32 of the push button switch element 40.

The push button switch element 40 may be received in a casing of a unit such as a portable telephone or the like while being mounted on a circuit board through a click plate or the like in such a manner that the transparent key top members 32 are each projected at a distal end thereof outwardly of the casing so as to be pressedly operable. Such construction permits pressed operation of the transparent key top members 32 to press a dome portion of the click plate, to thereby bring a movable contact on the dome portion into contact with a fixed contact on the circuit board, resulting in a circuit on the circuit board being operated.

The printed layer 24 may be designed so as to arrange symbols or the like defined in correspondence to a function of the key top members thereon by printing by way of example. Actually, photographs, computer graphics, high-precision geometric patterns or the like may be arranged on the printed layer 24 as desired. Also, when a back-lighted character is desired to be arranged on the printed layer 24, the printed layer 24 may be freely designed without requiring darkening of an outer periphery of the character which is carried out in the prior art, because the light-reflecting light-blocking layer 26 is arranged on the rear side of the printed layer 24. For example, when an outer periphery of a perforated character is light-colored and the perforated character is deep-colored, a back-lighted character which permits light upwardly directed to transmit through only the character may be obtained because the light-blocking layer is arranged on a rear side of the outer periphery of the character. It is not necessarily required that the perforated sections 27 are each formed to have a configuration identical with that of the character. For example, the perforated sections 27 may each be formed to be larger than the character or formed to have a fine mesh-like shape.

Now, manufacturing of the push button switch element of the illustrated embodiment thus constructed will be described hereinafter.

First, the resin sheet member 22 made of a thermoplastic resin material is subjected to a surface treatment for printing, if required. For this purpose, the resin sheet member 22 is subjected to a plasma treatment, a corona discharge treatment, a primer treatment or the like in order to increase adhesion thereof by way of example. Then, the resin sheet member 22 is coated thereon with an ink receiving layer, an ink absorbing layer or an ink adhering layer for adhering an ink in the printer 62 thereto by means of a coater. Then, the printed layer 24 including predetermined symbols or the like for a keyboard are printed on the resin sheet member 22 by means of the printer 62. Then, the light-reflecting light-blocking layer 26 formed with the perforated sections 27 and the semitransparent white layer 28 are arranged on the resin sheet member 22, resulting in the printed sheet 30 being provided. Then, the transparent key top members 32 are fixedly mounted on the thus-formed printed sheet 30 by means of the transparent adhesive 34. Also, the rubber cover base 38 is integrally bonded to a lower surface of the printed sheet 30 through the adhesive 36, so that the push button switch element 40 shown in FIG. 4 may be provided.

The semitransparent white layer 28 may be formed either by any suitable techniques such as printing, hot stamping, coating or the like or by lamination of a white sheet.

The key top members 32 may each be formed of a resin material by injection molding, cast molding or the like. In order to ensure satisfactory mounting of the printed sheet 30 on the key top members 32, a rear surface of the members 32 to which the printed sheet 30 is bonded is desirably formed to be as flat as possible.

The transparent key top members 32 thus provided are each fixed on a predetermined portion of the printed sheet 30 through the transparent adhesive 34 and then the printed sheet 30 is fixed on the rubber cover base 38, resulting in the push button switch element 40 being provided.

The push button switch element 40 may be mounted on a circuit board, to thereby constitute a switch. More particularly, the push button switch element is received in a casing of a unit such as a portable telephone while being mounted on the circuit board, to thereby constitute a push button switch used for inputting of a telephone number or the like.

The push button switch element of the illustrated embodiment permits printing of a colorful design to be readily realized. Also, arrangement of the light-reflecting light-blocking layer 26 substantially increases visibility of a keyboard even when it is arranged in a dark or poorly lighted environment such as the evening, cloudy weather, a poorly lighted room or the like. Thus, the illustrated embodiment permits the push-button switch element to be manufactured at a reduced cost while providing the key top members with increased design properties. Also, it permits the push button switch element to be reduced in manufacturing cost even when it is of the back-lighted type or reflection type, so that diversified small-quantity production thereof may be effectively attained without increasing the manufacturing cost. In addition, the printed display sections are each integrated with the rear surface of the key top member, to thereby be increased in visibility and prevented from wearing, leading to an increase in durability of the display sections.

When character back-lighting is carried out, light emitted from a light source arranged below the push button switch element is observed through the perforated sections 27 of the light-reflecting and light-blocking layer 26, so that the printed layer 24 may be increased in lightness and chroma, leading to an increase in visibility. However, when the light source is not constructed so as to be kept constantly turned on, turning-off of the light source causes the printed layer 24 to be somewhat deteriorated in visibility because the perforated sections are free of the light-reflecting light-blocking layer 26. In the illustrated embodiment, the semitransparent white layer 28 is arranged in order to eliminate such a disadvantage. The semitransparent white layer 28 permits light emitted from the light source when it is turned on to permeate therethrough because it is semitransparent, resulting in ensuring satisfactory character back-lighting. Also, it contributes to an increase in lightness of the printed layer 24, to thereby increase visibility of the printed layer during turning-off of the light source, because it is colored white.

The light-reflecting light-blocking layer 26 may be formed by laminating of a semitransparent white resin sheet or printing of a semitransparent white ink. The lamination may be carried out using a semitransparent white polyester sheet, polycarbonate sheet, acrylic sheet or the like of 5 to 500 $\mu$m in thickness. The printing may take place by screen printing of a white ink or the like.

The transparent or semitransparent adhesive 36 functions to bond the printed sheet 30 to the light-permeable rubber cover base 38. Thus, any suitable adhesive may be used for this purpose. Also, when the push button switch element is not the back-lighted type, any opaque colored adhesive may be used. In the illustrated embodiment, a double-sided tape having an acrylic adhesive applied to both surfaces thereof may be used for this purpose without generation of unnecessary protrusion or ununiformity of the adhesive, resulting in any defect in a compact unit being eliminated when the push button switch element is incorporated in the unit.

The rubber cover base 38 may be made of a silicone rubber material, an EPDM material, a thermoplastic elastomer material or the like. When a silicone rubber material is used for the rubber cover base 38, the silicone rubber material is desirably subjected to a surface treatment for ensuring satisfactory bonding of the base 38 to the printed sheet 30. The surface treatments include corona discharge, UV cleaning (UV irradiation), EB irradiation, a flame treatment, coating of a coupling agent, coating of a primer and the like. In the illustrated embodiment, the surface of the silicone rubber is subjected to UV cleaning and then coated thereon with a silane coupling agent, resulting in the rubber cover base 38 being increased in bonding strength.

Figure 6:
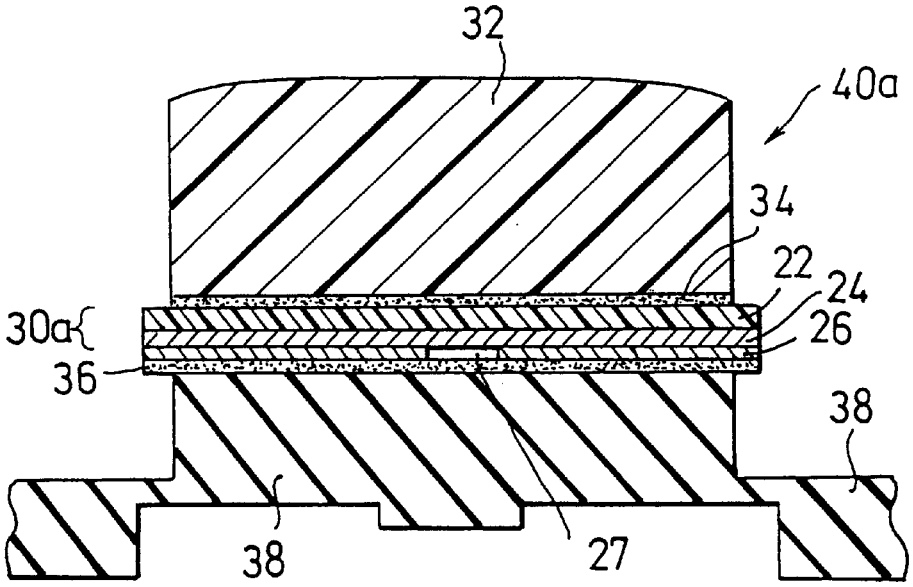
FIG. 6 is a fragmentary enlarged vertical sectional view showing another embodiment of a push button switch element according to the present invention.

In a push button switch element 40*a* shown in FIG. 6, the printed sheet 30*a* which is arranged between the key top members 32 and the rubber cover base 38 is constituted by the resin sheet member 22, the printed layer 24 and the light-reflecting light-blocking layer 26 formed with the perforated sections 27 which are integrally fixed together by the adhesive 34 and pressure sensitive adhesive double coated tape 36.

Figure 7:
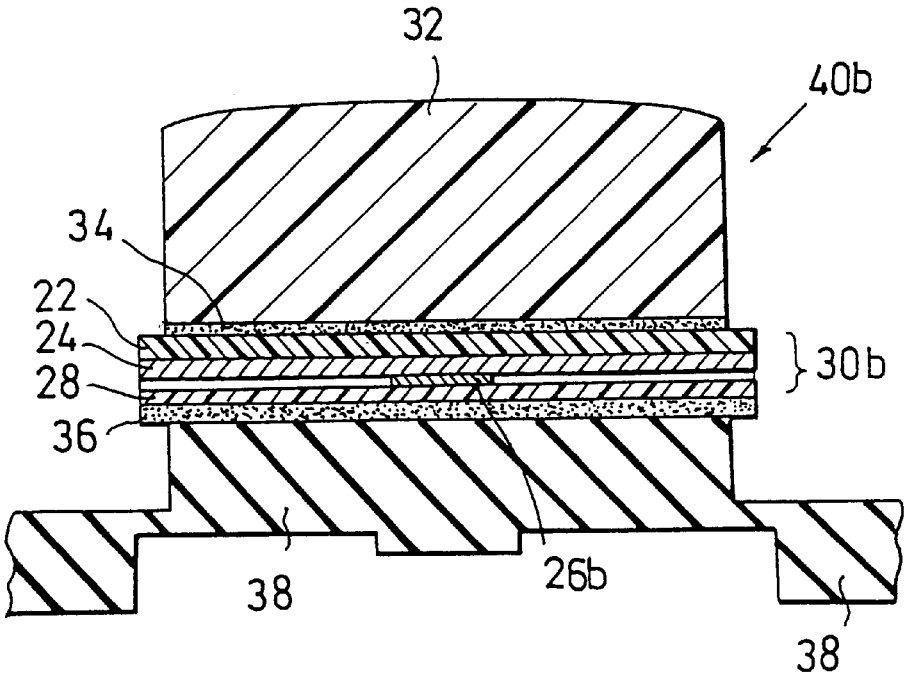
FIG. 7 is a fragmentary enlarged vertical sectional view showing a further embodiment of a push button switch element according to the present invention.

In a push button switch element 40*b* shown in FIG. 7, the light-reflecting light-blocking layer 26*b* of the printed sheet 30*b* is partially arranged. Use of a silver foil or the like permits the printed sheet 30*b* to be observed as a metallic color by reflected light. Also, observation using transmitted light permits the push button switch element to be used for a back-lighted key of which an outer periphery is back-lighted, because only the light-reflecting light-blocking layer 26*b* does not permit light to permeate therethrough.

As can be seen form the foregoing, in the push button switch element of the present invention, design data obtained by a computer are utilized for designing the display sections of the key top, resulting in a modification of the design and a correction thereof being facilitated. Also, the present invention eliminates a cost for form making or plate making and readily accommodates a variety of data for design formation, because the design is obtained by form-free or plate-free printing. The push button switch element of the present invention exhibits increased design properties which are never obtained by the conventional screen printing. Further, the printed layer can be printed with a light intermediate color, so that the printing formed of dot units having fine dot colors permits expression with a full color. In addition, the light-reflecting light-blocking layer is provided separately from the printed layer, therefore, the light-reflecting light-blocking layer may be made of an aluminum deposition foil or a material of a white color filled with a white pigment, resulting in exhibiting increased light reflectance, so that the printed layer may be increased in design properties. Moreover, when the light-reflecting light-blocking layer is constructed so as to exhibit light reflectance of 50% or more, the printed layer is highly enhanced in visibility and increased in both lightness and chroma, so that the push button switch element may exhibit improved design properties. Also, the printed layer is provided with a photograph, an illustration, a picture or the like with increased definition and quality, to thereby further enhance design properties of the push button switch element. In addition, the illustrated embodiment unlimitedly increases the number of colors to be displayed and reduces the manufacturing cost of the push button switch element exhibiting increased design properties. Furthermore, the illustrated embodiment increases the degree of freedom of the design of the printed layer, to thereby provide the push button switch element with a novel design and prevents an increase in manufacturing cost of the push button switch element even when diversified small-quantity production of the element takes place. Also, the push button switch element of the illustrated embodiment permits the printed display sections to exhibit increased visibility while preventing wearing thereof, resulting in exhibiting enhanced durability, because the printed display sections are each integrally mounted on the rear surface of a respective one of the key top members.

Furthermore, when the perforated sections of the light-reflecting light-blocking layer is formed to have a configuration corresponding to that of a character print pattern on the printed layer, the push button switch element may carry out character back-lighting. In this instance, when the perforated sections are formed to have a configuration different from that of the printed pattern, observation of the key top members by reflected light and that by transmitted light are rendered different from each other, so that design properties of the push button switch element may be further enhanced. Also, the illustrated embodiment permits the printing to be carried out on the light-permeable sheet member, resulting in mass production of the push button switch element being attained with increased efficiency as compared with printing on a shaped or molded article.

The invention will be understood more readily with reference to the following examples; however, these examples are intended to illustrate the invention and are not to be construed to limit the scope of the invention.

EXAMPLE 1

The printed sheet of the key top element according to the present invention was prepared by printing colored symbols and geometric patterns as a design for the key top on a transparent polyester sheet of 125 $\mu$m in thickness by means of a heat transfer sublimation type printer commercially available under the tradename "TRUEPRINT 3500" from Victor Co. of Japan, Ltd. The colored symbols and geometric patterns were designed using a personal computer.

Then, a semitransparent white polyester sheet of 25 $\mu$m in thickness was laminated on a rear surface of the polyester sheet thus printed, to thereby form the white-colored layer, resulting in the printed sheet being provided.

Subsequently, the transparent key top members were formed of a thermoplastic acrylic resin material to have a predetermined configuration by means of an injection molding machine. Twenty such transparent key top members were fixedly mounted on the printed sheet by means of a transparent polyester adhesive commercially available under the tradename "HIGHBON YA790-1" from Hitachi Kasei Polymer Co., Ltd., resulting in the key top element being prepared.

EXAMPLE 2

The printed sheet of the key top element was prepared by printing colored signs or symbols and geometric patterns as a design for the key top on a transparent polyester sheet of 125 $\mu$m in thickness by means of a laser exposure heat or thermal development transfer type printer commercially available under the tradename "PICTROGRAPHY-4000" from Fuji Photo Film Co., Ltd. The colored codes and geometric patterns were designed using a personal computer.

Then, an aluminum film was deposited on a rear surface of the thus-formed printed sheet by hot stamping, to thereby provide the silver-colored layer.

Thereafter, a photosetting acrylic resin material commercially available under the tradename "DIABEAM UT-1022" from Mitsubishi Rayon Co., Ltd. was subjected to cast molding using a mold of a predetermined configuration and then irradiated with ultraviolet rays, resulting in the transparent key top members being provided.

Then, the transparent key top members were bonded to the printed sheet by heating by means of a transparent silicone adhesive commercially available under the tradename "KE-1934" from Shin-Etsu Chemical Co., Ltd, resulting in the key top element being manufactured.

EXAMPLE 3

The printed sheet of the key top element was prepared by printing colored symbols and geometric patterns as a design for the key top on a transparent polyester sheet by means of an electrostatic transfer printer commercially available under the tradename "NEW PIXEL Dio 950" from CANON INC. The colored symbols and geometric patterns were designed using a personal computer.

Then, a semitransparent white polyester sheet was laminated on a rear surface of the polyester sheet, to thereby provide the printed sheet.

Subsequently, a thermoplastic acrylic resin material was formed into the transparent key top members of a predetermined configuration by means of an injection molding machine, which members were then adhered or bonded to the printed sheet, resulting in the key top element being manufactured.

EXAMPLE 4

The printed sheet of the key top element was prepared by printing colored symbols and geometric patterns as a design for the key top on a transparent polyester sheet by means of a dry-type two-ingredient toner electrophotographic printer commercially available under the tradename "LP-8000" from SEIKO EPSON CORPORATION. The colored symbols and geometric patterns were designed using a personal computer.

Then, an aluminum foil was deposited on a rear surface of the printed sheet by hot stamping, to thereby obtain the silver-colored layer.

Then, a thermoplastic acrylic resin material was formed into the transparent key top members of a predetermined configuration by means of an injection molding machine, which members were bonded to the printed sheet, resulting in the key top element being prepared.

In each of the key top elements obtained in Examples 1 to 4, the printed sheet was completely integrated with a rear surface of each of the transparent key top members. The key top element obtained in each of Examples 1 to 4 permitted the display section to be clearly observed and exhibited high quality.

EXAMPLE 5

One hundred transparent key top members having dimensions of 6 mm in length, 8 mm in width and 2 mm in height were formed of a thermoplastic polycarbonate resin material commercially available under the tradename "NOVAREX 7020 IR" from MITSUBISHI CHEMICAL CORPORATION by ordinary injection molding.

The printed sheet was made by printing a predetermined print pattern on a transparent PET sheet material of 125 $\mu$m in thickness by means of a color laser printer commercially available under the tradename "LP-8000C" from SEIKO EPSON CORPORATION. The printing provided graphic symbols, patterns or the like formed of dot units using a three primary color toner.

Then, metal aluminum was deposited on a printed surface of the printed sheet by vacuum vapor deposition techniques, to thereby provide the light-reflecting light-blocking layer. The aluminum deposition layer was varied in thickness between 30 Å and 300 Å. As a result, five such light-reflecting light-blocking layers varied in light reflectance between 30% and 90% were provided as shown in Table 1.

Thereafter, an adhesive obtained by blending a UV adhesive commercially available under the tradename "UNIDIC V-4221" from DAINIPPON INK AND CHEMICALS, INC. with 2.4 parts(PHR) of curing agent commercially available under the tradename "IRUGACURE #184" from Ciba-Geigy Ltd. was used for carrying out bonding between a rear side of the key top members and a PET sheet side of the printed sheet, to which side printing was applied. The bonding was carried out by irradiation using a high-pressure mercury vapor lamp of 80 W/cm for 10 seconds while keeping a distance from the lamp at 10 cm. This resulted in the key top members being fixed to the printed sheet.

The rubber cover base was made of a material prepared by adding 0.8 part(PHR) of vulcanizing agent commercially available under the tradename "C-8A" from Shin-Etsu Chemical Co., Ltd. to a silicone rubber commercially available under the tradename "KE-151u" from Shin-Etsu Chemical Co., Ltd. Then, the material was subjected to compression molding under heating, to thereby obtain the light-permeable rubber cover base. The rubber cover base thus prepared was sufficient to arrange fifteen such key top members thereon. Subsequently, the rubber cover base was irradiated on a bonding surface thereof with UV rays of 185 nm and 254 nm in wavelength and 40 W in output for about one minute by means of a UV irradiation system, resulting in the bonding surface being cleaned. Then, a pressure sensitive adhesive tape commercially available under the tradename "TACKLINER TL-250" from LINTECH Corporation which was cut out into substantially the same shape as the bonding surface of the rubber cover base was bonded to the bonding surface, resulting in the push button switch element being provided.

The thus-obtained push button switch element was subjected to illuminance measurement of the key top members for evaluation of visibility. The measurement was carried out in a normally lighted room (under 600 l×) by means of a measuring instrument commercially available under the tradename "BM-7" from TOPCON CORPORATION while the push button switch element was incorporated in a casing of a portable telephone. The results are shown in Table 1. As will be noted from the table, samples Nos. 3, 4 and 5 permitted printing on the printed sheet to be distinctly observed through the key top members. The printing provided a graphical picture or pattern which is formed of fine dot units and has quality like a photograph which is minute and highly colorful unlike that obtained by screen printing. Also, the push button switch elements Nos. 3 to 5 each reflected a small amount of external light to exhibit increased visibility when it was incorporated in a casing of a unit such as a portable telephone or the like. On the contrary, samples Nos. 1 and 2 each failed to exhibit satisfactory distinctness and visibility due to lack of external light when it was received in a casing of a unit such as a portable telephone.

TABLE 1

Visibility due to Light-Reflecting Light-Blocking (L-R/L-B) Layer

| Sample No. | Thickness of Deposited Aluminum of L-R/L-B Layer(Å) | Light Reflectance (%) | Results of Measurement of Illuminance (cd/m$^2$) | Results of Evaluation of Visibility |
|---|---|---|---|---|
| 1 | 30 | 30 | ≦0.5 | X: Lightness was reduced to render reading of a figure difficult. |
| 2 | 80 | 45 | 0.8 | X: Printing was observed but indistinct and hard to read. |
| 3 | 100 | 50 | 1.0 | ○: Observation was good when the element was incorporated in the casing. |
| 4 | 150 | 70 | 2.0 | ○: Fine colors were distinct and discriminated. |
| 5 | 300 | 90 | 3.0 | ○: A metallic tone was emphasized and distinct. |

EXAMPLE 6

Fifteen such transparent key top members having dimensions of 6 mm in length, 8 mm in width and 2 mm in height were formed of a thermosetting unsaturated polyester resin material commercially available under the tradename "ESTAR C755-1" from Mitsui Chemicals, Inc. and blended with a curing agent in an amount of 1% commercially available under the tradename "PERHEXA 3M" from NOF CORPORATION by cast molding under heating at a temperature of 170° C. for 5 minutes.

The printed sheet was made by printing a predetermined print pattern on a transparent PET sheet material of 125 μm in thickness by means of a color printer of the heat transfer sublimation type commercially available under the tradename "TRUEPRINT 3500" from Victor Co. of Japan. The printing provided graphic symbols, patterns or the like formed of dot units using a CMYK color sublimation ink system.

Then, an aluminum deposition foil commercially available under the tradename "PLATINUM SILVER INK JP-T3201" from Victor Co. of Japan was printed in a predetermined pattern on a print surface of the printed sheet by heat transfer by means of a color printer of the heat transfer sublimation type commercially available under the tradename "TRUEPRINT 3500" from Victor Co. of Japan, resulting in the light-reflecting light-blocking layer having the punched or perforated sections of a predetermined configuration being obtained. The light-reflecting light-blocking layer thus obtained had light reflectance of 60%.

Then, the semitransparent white layer was laminated all over the light-reflecting light-blocking layer through an acrylic adhesive by contact bonding. The semitransparent white layer was made of a white PET sheet material of 50 μm in thickness commercially available under the tradename "LUMIRROR X-20" from TORAY INDUSTRIES, INC.

Then, the UV adhesive commercially available under a tradename "DIABOND UV-147" from Nogawa Chemical Co., Ltd. was used to carry out bonding between a rear side of the key top members and the PET sheet side of the printed sheet, to which side printing was not applied, by irradiation using a high-pressure mercury vapor lamp of 80 W/cm for 30 seconds while keeping a distance from the lamp at 15 cm. This resulted in fifteen such key top members being fixed to the printed sheet.

The rubber cover base was made of a material prepared by adding 0.8 part(PHR) of vulcanizing agent commercially available under the tradename "C-8A" from Shin-Etsu Chemical Co., Ltd. to a silicone rubber commercially available under the tradename "KE-151u" from Shin-Etsu Chemical Co., Ltd. Then, the material was subjected to compression molding under heating, to thereby obtain the light-permeable rubber cover base. The rubber cover base thus prepared was sufficient to arrange fifteen key top members thereon. Then, the rubber cover base was irradiated on a bonding surface thereof with UV rays of 185 nm and 254 nm in wavelength and 40 W in output for about one minute by means of a UV irradiation system, resulting in the bonding surface being cleaned. Then, the primer commercially available under a tradename "KE-1800C" from Shin-Etsu Chemical Co., Ltd. was applied in a small amount to the bonding surface of the rubber cover base, followed by air-drying.

Then, a pressure sensitive adhesive tape commercially available under a tradename "HIGHBON 11-583" from Hitachi Chemical Polymer Co., Ltd. was punched into substantially the same configuration as the bonding surface of the rubber cover base and used for carrying out bonding between the printed sheet having the key top members fixed thereon and the rubber cover base, followed by heating at 100° C. for 30 minutes in a dryer to enhance the bonding, resulting in the push button switch element being provided.

The thus-obtained push button switch element permitted printing on the printed sheet to be distinctly observed through the transparent key top members. The printing provided the graphical picture or pattern which is formed of fine dot units and has quality like a photograph which is minute and highly colorful unlike that obtained by screen printing. Also, the light-reflecting light-blocking layer made of an aluminum deposition foil permitted the printing to have a bright and metallic tone. Further, the perforated sections of the light-reflecting light-blocking layer permitted light upwardly directed to the push button switch element from below to partially selectively permeate through the perforated sections, resulting in a character or the like defined by the configuration of the perforated section being clearly observed.

EXAMPLE 7

Fifteen such transparent key top members having dimensions of 6 mm in length, 8 mm in width and 2 mm in height were formed of a thermoplastic polycarbonate resin material commercially available under the tradename "NOVAREX 7020 IR" from MITSUBISHI CHEMICAL CORPORATION by ordinary injection molding.

The printed sheet was made by printing a predetermined print pattern on a transparent PET sheet material of 200 $\mu$m in thickness by means of a color printer of the heat transfer sublimation type commercially available under the tradename "TRUEPRINT 3500" from Victor Co. of Japan. The printing provided graphic symbols, patterns or the like formed of dot units using a CMYK color sublimation ink system.

Subsequently, a film of 55% in light reflectance commercially available under the tradename "LUMICOOL 1015" from LINTECH Corporation was integrally laminated on a print surface of the printed sheet by means of an acrylic pressure sensitive adhesive, to thereby prepare the light-reflecting light-blocking layer.

Thereafter, an adhesive obtained by blending a UV adhesive commercially available under the tradename "UNIDIC V-4221" from DAINIPPON INK AND CHEMICALS, INC. with 3.0 parts(PHR) of curing agent commercially available under the tradename "IRUGACURE #184" from Ciba-Geigy Ltd. was used for attaining bonding between a rear side of the key top members and a PET sheet side of the printed sheet, to which side printing was not applied. The bonding was carried out by irradiation using a high-pressure mercury vapor lamp of 80 W/cm for 10 seconds while keeping a distance from the lamp at 10 cm. This resulted in a key top element which has fifteen such key top members fixed onto the printed sheet being provided.

The rubber cover base was made of a material prepared by adding 1.0 part(PHR) of vulcanizing agent commercially available under the tradename "C-8A" from Shin-Etsu Chemical Co., Ltd. to a silicone rubber commercially available under the tradename "KE-151u" from Shin-Etsu Chemical Co., Ltd. Then, the material was subjected to compression molding under heating, to thereby obtain the light-permeable rubber cover base. The rubber cover base thus prepared was sufficient to arrange fifteen key top members thereon. Then, the rubber cover base was irradiated on a bonding surface thereof with UV rays of 185 nm and 254 nm in wavelength and 40 W in output for about 1.5 minutes by means of a UV irradiation system, resulting in the bonding surface being cleaned. Then, a pressure sensitive adhesive tape commercially available under the tradename "TACKLINER TL-250" from LINTECH Corporation which was cut out into substantially the same shape as the bonding surface of the rubber cover base was bonded to the bonding surface, resulting in the push button switch element being provided.

The thus-obtained push button switch element permitted printing on the printed sheet to be distinctly observed through the transparent key top members. Also, the printing had quality like a photograph which is minute and highly colorful unlike that obtained by screen printing. Further, the light-reflecting light-blocking layer permitted light upwardly directed to the push button switch element from below to be clearly observed in a pattern by light permeating through a periphery of the light-reflecting light-blocking layer.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A key top element comprising:

a printed sheet having at least one printed display section formed thereon, said printed sheet including a substrate sheet member made of a light-permeable material, an on-demand printed layer constituting said printed display section, and a colored layer which has a color selected from the group consisting of the color white and the color silver; and at least one push button-shaped key top member made of a light-permeable resin material, said at least one push button-shaped key top member being arranged with respect to said printed sheet so as to positionally correspond to said printed display section and so that said printed layer is arranged between said push button-shaped key top member and said colored layer.

2. A key top element as defined in claim 1, wherein said printed sheet and said key top member are integrally fixed together through a light-permeable adhesive.

3. A key top element as defined in claim 1, wherein said on-demand printed layer is arranged on a lower surface of said substrate sheet member and said colored layer is arranged on said on-demand printed layer.

4. A key top element as defined in claim 1, wherein said on-demand printed layer is arranged on an upper surface of said substrate sheet member and said colored layer is arranged on a lower surface of said substrate sheet member.

5. A key top element as defined in claim 1, wherein said on-demand printed layer is formed of fine dots of a plurality of colors, to thereby render said display section light-permeable.

6. A key top element as defined in claim 2, wherein said light-permeable adhesive is selected from the group consisting of a transparent adhesive and a semi-transparent adhesive.

7. A key top element as defined in claim 1, wherein said substrate sheet member is made of a light permeable material selected from the group consisting of a transparent thermal plastic resin material and a semitransparent thermal plastic resin material.

8. A key top element as defined in claim 1, wherein said colored layer is semitransparent.

9. A key top element as defined in claim 1, wherein said colored layer is light-blocking.

10. A method for manufacturing a key top element, comprising of steps of:

subjecting a substrate sheet member made of a light-permeable resin material to color printing using fine dots of a plurality of colors by feeding a printing unit with color design data obtained by computer design techniques, to thereby form an on-demand printed layer including at least one printed display section;

forming a colored layer which has a color selected from the group consisting of white and silver on one surface of said substrate sheet member having said printed display section printed thereon to provide a printed sheet; and integrally mounting at least one key top member made of a light permeable resin material on a pre-determined portion of said printed sheet so that said printed display section is arranged between said key top member and said colored layer.

11. A method as defined in claim 10, wherein said on-demand printed layer is formed by said printing unit using at least one printing technique selected from the group consisting of heat transfer sublimation printing techniques, toner electronic printing techniques, electrostatic image printing techniques, laser exposure heat development transfer printing techniques, ink jet printing techniques and thermal color development printing techniques.

12. A method as defined in claim 11, wherein said printed sheet and transparent key top member are integrally fixed on each other by means of a light-permeable adhesive.

13. A method as defined in claim 12, wherein said light-permeable adhesive is selected from the group consisting of a transparent adhesive and a semitransparent adhesive.

14. A method as defined in claim 11, wherein said printed display section is formed substantially by full-color printing using inks of one ink system selected from the group consisting of a CMY ink system, a CMYK ink system and an RGB ink system.

15. A method as defined in claim 14, wherein said on-demand printed layer is arranged on a lower surface of said substrate sheet member and said colored layer is arranged on said on-demand printed layer.

16. A method as defined in claim 14, wherein said on-demand printed layer is arranged on an upper surface of said substrate sheet member and said colored layer is arranged on a lower surface of said substrate sheet member.

17. A method as defined in claim 10, wherein said substrate sheet member is made of a light-permeable resin material selected from the group consisting of a transparent thermal plastic resin material and a semitransparent thermal plastic resin material.

18. A push button switch element comprising:

at least one light-permeable key top member formed of a light-permeable resin material;

a light-permeable rubber cover base; and a printed sheet interposedly arranged between said light-permeable key top member and said light-permeable rubber cover base and formed with at least one display section;

said printed sheet including a light-permeable resin sheet member, a graphic printed layer folmed on one surface of said light-permeable resin sheet member of the fine dots of a plurality of colors so that said display section is light-permeable, and a light-reflecting light-blocking layer, and said printed sheet being arranged with respect to said light-permeable key top member so that said graphic printed layer is arranged between said light-permeable key top member and said light-reflecting light-blocking layer.

19. A push button switch element as defined in claim 18, wherein said light-reflecting light-blocking layer has light reflectance of 50% or more.

20. A push button switch element as defined in claim 19, further comprising a semitransparent white layer arranged on a lower surface of said light-reflecting light-blocking layer.

21. A push button switch element as defined in claim 20, wherein said light-reflecting light-blocking layer is formed with a perforated section of a predetermined shape in a manner to positionally correspond to said display section.

22. A push button switch element as defined in claim 20, wherein said light-reflecting light-blocking layer is formed all over one surface of said printed sheet.

23. A push button switch element as defined in claim 20, wherein said light-permeable resin sheet member is formed on one surface thereof with an ink receiving layer; and said graphic printed layer is provided on said ink receiving layer.

24. A push button switch element as defined in claim 20, wherein said printed sheet, light-permeable key top member and light-permeable rubber cover base are integrally fixed together by means of light-permeable adhesives.

25. A push button switch element is defined in claim 24, wherein said light-permeable adhesives are selected from the group consisting of transparent adhesives and semitransparent adhesives.

26. A push button switch element as defined in claim 19, wherein said printed sheet, light-permeable key top member and light-permeable rubber cover base are integrally fixed together by means of light-permeable adhesives.

27. A push button switch element as defined in claim 26, wherein said light-permeable adhesives are selected from the group consisting of transparent adhesives and semitransparent adhesives.

28. A push button switch element as defined in claim 19, wherein said light-reflecting light-blocking layer is formed all over one surface of said printed sheet.

29. A push button switch element as defined in claim 19, wherein said light-reflecting light-blocking layer is formed with a perforated section of a predetermined shape in a manner to positionally correspond to said display section.

30. A push button switch element as defined in claim 19, wherein said light-permeable resin sheet member is formed on one surface thereof with an ink receiving layer; and said graphic printed layer is provided on said ink receiving layer.

31. A push button switch element as defined in claim 18, wherein said light-permeable key top member is formed of a light-permeable resin material selected from the group consisting of a transparent resin material and a semitransparent resin material.

32. A push button switch element as defined in claim 18, wherein said light-reflecting light-blocking layer is arranged on a lower side of said graphic printed layer so that said graphic printed layer is arranged between said light-reflecting light-block layer and said key top member.

33. A push button switch element as defined in claim 18, further comprising a semitransparent white layer arranged on a lower surface of said light-reflecting light-blocking layer.

34. A method for manufacturing a push button switch element, comprising the steps of:

forming a graphic printed layer including at least one light-permeable display section on one surface of a light-permeable resin sheet member using fine dots of a plurality of colors by means of a printer;

arranging a light-reflecting light-blocking layer on a lower side of said graphic printed layer to provide a printed sheet having an upper surface and a lower surface and having said light-reflecting light-blocking layer arranged between said graphic printed layer and said lower surface of said printed sheet; and bonding at least one light-penneable key top member made of a light-permeable resin material to said upper surface of said printed sheet and bonding a light-permeable rubber cover base to said lower surface of said printed sheet to provide said push button switch element.

35. A method as defined in claim 34, wherein said light-reflecting light-blocking layer has light reflectance of 50% or more.

36. A method as defined in claim 35, wherein said light-permeable resin sheet member is formed on one surface thereof with an ink receiving layer; and said graphic printed layer is provided on said ink receiving layer.

37. A method as defined in claim 35, wherein said light-reflecting light-blocking layer is formed at a portion thereof positionally corresponding to said light-permeable display section with a respective perforated section of a predetermined configuration.

38. A method as defined in claim 35, wherein said light-reflecting light-blocking layer is formed all over one surface of said printed sheet.

39. A method as defined in claim 35, wherein said light-reflecting, light-blocking layer is formed by a technique selected from the group consisting of heat transfer of a thin metal film, hot stamping thereof, deposition thereof, ion plating thereof, sputtering thereof, metallic printing of a light-reflecting light-blocking ink, and laminating of a light-reflecting light-blocking sheet.

40. A method as defined in claim 35, further comprising the step of arranging a semitransparent white layer on a lower surface of said light-reflecting light-blocking layer to provide said printed sheet.

41. A method as defined in claim 40, wherein said light-permeable resin sheet member is formed on one surface thereof with an ink receiving layer; and said graphic printed layer is provided on said ink receiving layer.

42. A method as defined in claim 40, wherein said light-reflecting light-blocking layer is formed all over one surface of said printed sheet.

43. A method as defined in claim 40, wherein said light-reflecting light-blocking layer is formed by a technique selected from the group consisting of heat transfer of a thin metal film, hot stamping thereof, deposition thereof, ion plating thereof, sputtering thereof, metallic printing of a light-reflecting light-blocking ink, and laminating of a light-reflecting light-blocking sheet.

44. A method as defined in claim 40, wherein said light-reflecting light-blocking layer is formed at a portion thereof positionally corresponding to said light-permeable display section with a respective perforated section of a predetermined configuration.

45. A method as defined in claim 40, wherein said printed sheet, light-permeable key top member and light-permeable rubber cover base are integrally fixed together by means of light-permeable adhesives.

46. A method is defined in claim 45, wherein said light-permeable adhesives are selected from the group consisting of transparent adhesives and semitransparent adhesives.

47. A method as defined in claim 35, wherein said printed sheet, light-permeable key top member and light-permeable rubber cover base are integrally fixed together by means of light-permeable adhesives.

48. A method is defined in claim 47, wherein said light-permeable adhesives are selected from the group consisting of transparent adhesives and semitransparent adhesives.

49. A method as defined in claim 34, further comprising the step of arranging a semitransparent white layer on a lower surface of said light-reflecting light-blocking layer to provide said printed sheet.

50. A method as defined in claim 34, wherein said light permeable key top member is made of a light-permeable resin material selected from the group consisting of a transparent resin material and a semitransparent resin material.

51. A push button switch element comprising:

at least one light-permeable key top member formed of a light-permeable resin material;

a light-permeable rubber cover base; and a printed sheet interposedly arranged between said light-permeable key top member and said light-permeable rubber cover base and formed with at least one display section;

said printed sheet including a light-permeable resin sheet member, a graphic printed layer formed on one surface of said light-permeable resin sheet member of fine dots of a plurality of colors so that said display section is light-permeable, a light-reflecting light-blocking layer arranged on a lower side of said graphic printed layer, and a semitransparent white layer arranged on a lower surface of said light-reflecting light-blocking layer.

52. A push button switch element is defined in claim 51, wherein said light-permeable key top member is formed of a light-permeable resin material selected from the group consisting of a transparent resin material and a semitransparent resin material.

53. A push button switch element is defined in claim 51, wherein said printed sheet, light-permeable key top member and light-permeable rubber cover base are integrally fixed together by means of light-permeable adhesives.

54. A push button switch element is defined in claim 51 wherein said light-reflecting light-blocking layer is formed all over one surface of said graphic printed layer.

55. A push button switch element is defined in claim 51, wherein said light-reflecting light-blocking layer is formed with a perforated section of a predetermined shape in a manner to positionally correspond to said display section.

56. A push button switch element is defined in claim 51 wherein said light-permeable resin sheet member is formed on one surface thereof with an ink receiving layer;

and said graphic printed layer is provided on said ink receiving layer.

57. A push button switch element comprising:

at least one light-permeable key top member formed of a light-permeable resin material;

a light-permeable rubber cover base; and a printed sheet interposedly arranged between said light-permeable key top member and said light-permeable rubber cover base and formed with at least one display section;

said printed sheet including a light permeable resin sheet member, a graphic printed layer formed on one surface of said light permeable resin sheet member of fine dots of a plurality of colors so that said display section is light-penneable, a light-reflecting light-blocking layer arranged on a lower side of said graphic printed layer and having a light reflectance of 50% or more, and a semitransparent white layer arranged on a lower surface of said light-reflecting light-blocking layer.

58. A push button switch element as defined in claim 57, wherein said light-permeable key top member is formed of a light-penneable resin material selected from the group consisting of a transparent resin material and a semitransparent resin material.

59. A push button switch element as defined in claim 57, wherein said printed sheet, light-permeable key top member and light-permeable rubber cover base are integrally fixed together by means of light-permeable adhesives.

60. A push button switch element as defined in claim 57, wherein said light-reflecting light-blocking layer is formed all over one surface of said graphic printed layer.

61. A push button switch element as defined in claim 58, wherein said light-reflecting light-blocking layer is formed with a perforated section of a predetermined shape in a manner to positionally correspond to said display section.

62. A push button switch element as defined in claim 58, wherein said light-permeable resin sheet member is formed on one surface thereof with an ink receiving layer; and said graphic printed layer is provided on said ink receiving layer.

63. A method for manufacturing a push button switch element, comprising the steps of:

forming a graphic printed layer including at least one light permeable display section on one surface of a light-permeable resin sheet member using fine dots of a plurality of colors by means of a printer;

arranging a light-reflecting light-blocking layer on a lower side of said graphic printed layer and arranging a semitransparent white layer on a lower surface of said light-reflccting light-blocking layer to provide a printed sheet; and bonding at least one light-permeable key top member made of a light-permeable resin material to an upper surface of said printed sheet and bonding a light-permeable rubber cover base to a lower surface of said printed sheet to provide said push button switch element.

64. A method as defined in claim 63, wherein said light-permeable key top member is made of a light-permeable resin material selected from the group consisting of a transparent resin material and a semitransparent resin material.

65. A method as defined in claim 63, wherein said printed sheet, light-permeable key top member and light-permeable rubber cover base are integrally fixed together by means of light-permeable adhesives.

66. A method as defined in claim 63, wherein said light-reflecting light-blocking layer is forned by a technique selected from the group consisting of heat transfer of a thin metal film, hot stamping thereof, deposition thereof, ion plating thereof, sputtering thereof, metallic printing of a light-reflecting light-blocking ink, and laminating of a light-reflecting light-blocking sheet.

67. A method as defined in claim 63, wherein said light-reflecting light-blocking layer is formed all over one surface of said graphic printed layer.

68. A method as defined in claim 63, wherein said light-reflecting light-blocking layer is formed at a portion positionally corresponding to said light-permeable display section with a respective perforated section of a predetermined configuration.

69. A method as defined in claim 63, wherein said light-permeable resin sheet member having said graphic printed layer thereon is formed on one surface thereof with an ink rcceiving layer; and said graphic printed layer is provided on said ink receiving layer.

70. A method for manufactuing a push button switch element, comprising the steps of:

forming a graphic printed layer including at least one light-permeable display section on one surface of a light-permeable resin sheet member using fine dots of a plurality of colors by means of a printer;

arranging a light-reflecting light-blocking layer having light reflectance of 50% or more on a lower side of said graphic printed layer and arranging a semitransparent white layer on a lower surface of said light-reflecting light-blocking layer to provide a printed sheet; and bonding at least one light-permeable key top member made of a light-permeable resin material to an upper surface of said printed sheet and bonding a light-permeable rubber cover base to a lower surface of said printed sheet to provide said push button switch element.

71. A method as defined in claim 70, wherein said light-permeable key top member is made of a light-permeable resin material selected from the group consisting of a transparent resin material and a semitransparent resin material.

72. A method as defined in claim 70, wherein said printed sheet, light-permeable key top member and light-permeable rubber cover base are integrally fixed together by means of light-permeable adhesives.

73. A method as defined in claim 70, wherein said light-reflecting light-blocking layer is formed by a technique selected from the group consisting of heat transfer of a thin metal film, hot stamping thereof, deposition thereof, ion plating thereof, sputtering thereof, metallic printing of a light-reflecting light-blocking ink, and laminating of a light-reflecting light-blocking sheet.

74. A method as defined in claim 70, wherein said light-reflecting light-blocking layer is formed all over one surface of said graphic printed layer.

75. A method as defined in claim 70, wherein said light-reflecting light-blocking layer is formed at a portion thereof positionally corresponding to said light-permeable display section with a respective perforated section of a predetennined configuration.

76. A method as defined in claim 70, wherein said light-permeable resin sheet member having said graphic printed layer thereon is formed on one surface thereof with a ink receiving layer;

and said graphic printed layer is provided on said ink receiving layer.

* * * * *

UNITED STATES PATENT AND TRADEMARK OFFICE

CERTIFICATE OF CORRECTION

PATENT NO. : 6,196,738 B1
DATED : March 6, 2001
INVENTOR(S) : Shimizu et al.

It is certified that error appears in the above-identified patent and that said Letters Patent is hereby corrected as shown below:

Column 2,
Line 15, after "in" insert -- it --.

Column 6,
Line 38, after "members" insert -- , --.
Line 39, after "switch" insert -- , --.
Line 40, after "material" insert -- , --.

Column 9,
Line 3, "an" should read -- a --.

Column 10,
Line 38, "exhibit" should read -- exhibits --.

Column 13,
Line 40, after "element" insert -- is --.

Column 15,
Line 32, after "addition," insert -- if --.

Column 19,
Line 34, "are" should read -- is --.

Column 21,
Line 62, "is" should read -- are --.

Column 23,
Line 21, "8000" should read -- 8000C --.

Column 25,
Line 57, "a" should read -- the --.

UNITED STATES PATENT AND TRADEMARK OFFICE

CERTIFICATE OF CORRECTION

PATENT NO. : 6,196,738 B1
DATED : March 6, 2001
INVENTOR(S) : Shimizu et al

It is certified that error appears in the above-identified patent and that said Letters Patent is hereby corrected as shown below:

Column 26,
Line 32, "a" should read -- the --.
Line 37, "a" should read -- the --.
Line 48, "the" should read -- a --.

Column 28,
Line 47, "of" should read -- the --.
Line 60, "light permeable" should read -- light-permeable --.

Column 30,
Line 38, "block" should read -- blocking --.

Column 31,
Line 10, after "reflecting" cancel -- , --.
Line 44, "is" should read -- as --.
Line 51, "is" should read -- as --.

Column 32,
Line 9, "is" should read -- as --.
Line 14, "is" should read -- as --.
Line 18, "is" should read -- as --.
Line 21, "is" should read -- as -- .
Line 25, "is" should read -- as --.
Line 42, "penneable" should read -- permeable --.
Line 49, "penneable" should read -- permeable --.
Line 59, "58" should read -- 57 --.
Line 63, "58" should read -- 58 --.

UNITED STATES PATENT AND TRADEMARK OFFICE

CERTIFICATE OF CORRECTION

PATENT NO. : 6,196,738 B1
DATED : March 6, 2001
INVENTOR(S) : Shimizu et al

It is certified that error appears in the above-identified patent and that said Letters Patent is hereby corrected as shown below:

Column 33,
Line 3, after "light" insert --

Column 34,
Line 39, "predetennined" should read -- predetermined --.
Line 43, "a" should read -- an". --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*